United States Patent [19]

Tateishi et al.

[11] Patent Number: 5,003,137

[45] Date of Patent: Mar. 26, 1991

[54] SWITCH

[75] Inventors: Tokio Tateishi; Shizutaka Nishizako; Harumi Hiraki; Shigeru Masuda, all of Nagoya; Teijiro Mori, Amagasaki; Syunichi Sutoh, Nagoya, all of Japan

[73] Assignee: Mitsubishi Denki Kabushiki Kaisha, Tokyo, Japan

[21] Appl. No.: 488,362

[22] Filed: Feb. 12, 1990

Related U.S. Application Data

[63] Continuation of Ser. No. 159,848, filed as PCT JP87/00345 on May 28, 1987, published as WO87/07427 on Dec. 3, 1987, abandoned.

[30] Foreign Application Priority Data

| | | | |
|---|---|---|---|
| May 30, 1986 | [JP] | Japan | 61-123791 |
| May 30, 1986 | [JP] | Japan | 61-123792 |
| May 30, 1986 | [JP] | Japan | 61-123793 |
| May 30, 1986 | [JP] | Japan | 61-123794 |
| May 30, 1986 | [JP] | Japan | 61-123800 |
| Jun. 3, 1986 | [JP] | Japan | 61-127132 |
| Jun. 3, 1986 | [JP] | Japan | 61-127133 |
| Jun. 3, 1986 | [JP] | Japan | 61-127136 |
| Jun. 6, 1986 | [JP] | Japan | 61-130383 |
| Jun. 10, 1986 | [JP] | Japan | 61-132834 |
| Jun. 17, 1986 | [JP] | Japan | 61-139153 |
| Jun. 19, 1986 | [JP] | Japan | 61-141366 |
| Jun. 19, 1986 | [JP] | Japan | 61-141369 |
| Jun. 23, 1986 | [JP] | Japan | 61-144975 |
| Jun. 25, 1986 | [JP] | Japan | 61-146822 |
| Jun. 27, 1986 | [JP] | Japan | 61-149681 |
| Jul. 2, 1986 | [JP] | Japan | 61-154159 |
| Jul. 11, 1986 | [JP] | Japan | 61-162002 |
| Jul. 28, 1986 | [JP] | Japan | 61-175703 |
| Jul. 31, 1986 | [JP] | Japan | 61-116651 |

[51] Int. Cl.[5] ..... H01H 33/08

[52] U.S. Cl. ..... 200/144 R; 200/147 R

[58] Field of Search ..... 200/144 R, 147 R, 147 B

[56] References Cited

U.S. PATENT DOCUMENTS

| | | | |
|---|---|---|---|
| 1,963,643 | 6/1934 | Brainard | 200/144 R |
| 4,217,472 | 8/1980 | Gryctko et al. | 200/144 R |
| 4,229,630 | 10/1980 | Wafer | 200/147 R |
| 4,477,704 | 10/1984 | Mori et al. . | |
| 4,521,655 | 4/1985 | Okado et al. . | |
| 4,596,909 | 6/1986 | Kakizoe et al. . | |

FOREIGN PATENT DOCUMENTS

| | | |
|---|---|---|
| 1926355 | 11/1970 | Fed. Rep. of Germany . |
| 7333155 | 12/1973 | Fed. Rep. of Germany . |
| 30-11950 | 8/1955 | Japan . |
| 34-9310 | 6/1959 | Japan . |
| 49-41958 | 11/1974 | Japan . |
| 51-69764 | 6/1976 | Japan . |
| 53-63559 | 5/1978 | Japan . |
| 53-95277 | 8/1978 | Japan . |
| 53-149865 | 11/1978 | Japan . |
| 54-8667 | 1/1979 | Japan . |
| 58-13616 | 1/1983 | Japan . |
| 58-169819 | 10/1983 | Japan . |
| 59-117020 | 7/1984 | Japan . |
| 60-119028 | 6/1985 | Japan . |
| 60-119034 | 6/1985 | Japan . |
| 60-198015 | 10/1985 | Japan . |

*Primary Examiner*—Robert S. Macon

*Attorney, Agent, or Firm*—Oblon, Spivak, McClelland, Maier & Neustadt

[57] ABSTRACT

A switch for as an electromagnetic contactor, a circuit breaker for wiring, an air circuit breaker and so on is provided. The switch comprises a fixed contact 8A joined to a fixed contactor 8, an movable contact 6A joined to a movable contactor 6 to face the fixed contact, a plurality of arc extinguishing metallic plates 13 arranged with predetermined distances and in parallel to the fixed contactor 8 at the side of the end portion of the movable contactor 6 and a commutation plate 15 placed at the opposite side of the fixed contactor so as to interpose the movable contactor. In the switch, an end of the arc extinguishing metallic plates 13 is extended toward the movable contactor 6, and the end of the extended portion is cut to form leg portions 13*fa*, 13*ga* which allows the movement of the movable contact 6A, and it is moved to contact with the fixed contact 8A, whereby an arc produced between the movable contact 6A and the fixed contact 8A is rapidly attracted to the arc extinguishing metallic plates to allow interruption of a large electric current.

25 Claims, 34 Drawing Sheets

FIGURE 48
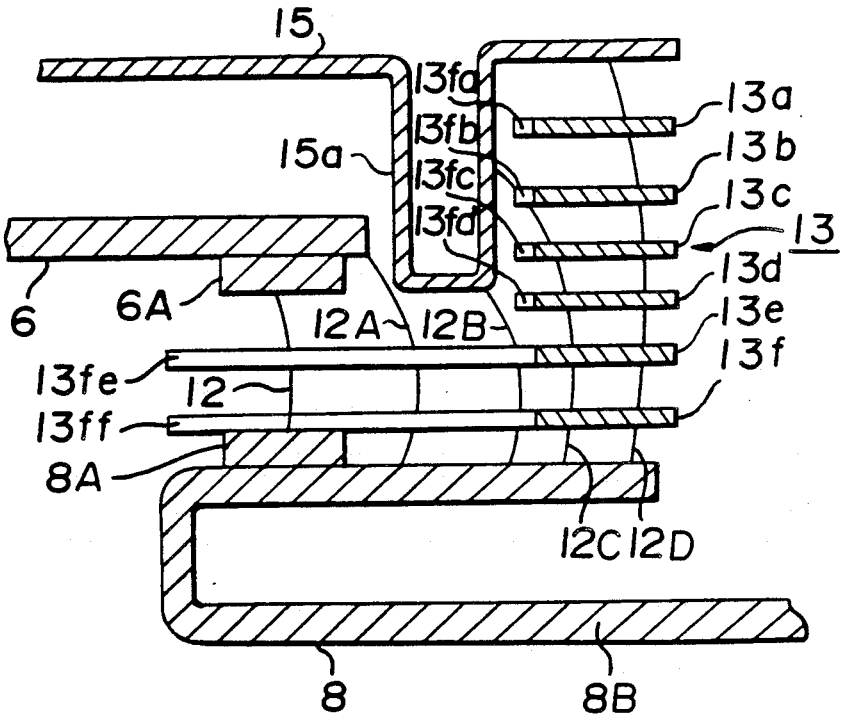
FIGURE 49
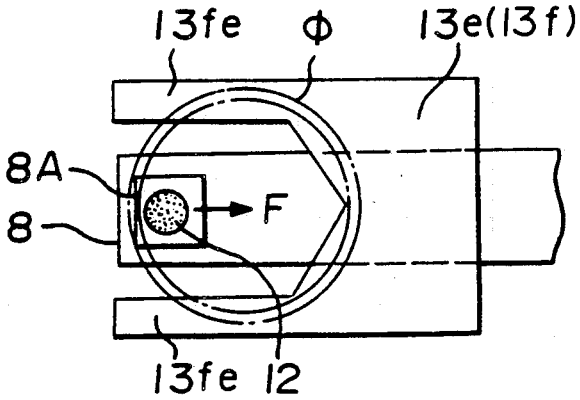
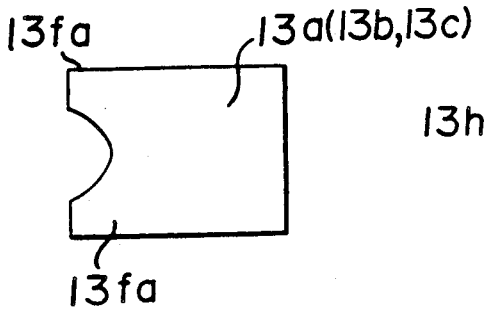
FIGURE 50(a)
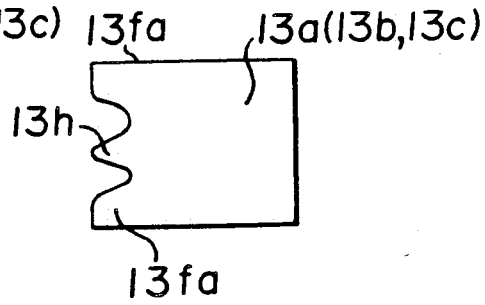
FIGURE 50(b)

SWITCH

This application is a continuation of application Ser. No. 07/159,848, filed as PCT JP87/00345 on May 28, 1987, published as WO87/07427 on Dec. 3, 1987, now abandoned.

TECHNICAL FIELD

The present invention relates to a switch for opening and closing an electric current, and more particularly, it relates to an arc extinguishing mechanism for the switch.

BACKGROUND ART

Switches for electric circuits are used for various fields. As conventional switches, there are known ones as proposed in, for instance, U.S. Pat. No. 4,477,704, U.S. Pat. No. 4,521,655 and so on.

FIG. 1 shows an example of a conventional switch. In FIG. 1, a reference numeral 1 designates fitting block formed by a synthetic resin, numeral 2 designates a fixed iron core formed by silicon steel plates on the fitting block, numeral 3 designates a movable iron core formed by the same silicon steel plates which is placed opposing the fixed iron core 2, numeral 4 designates an operating coil to impart a driving force to attract the movable iron core 3 to the fixed iron core 2 against a trip spring (not shown), and numeral 5 designates a cross bar having a rectangular window 2, which is formed by a synthetic resin and supports at its lower end the movable iron core 3.

Numeral 6 designates a movable contactor which is inserted in the rectangular window of the cross bar 5 and is held by a compression spring 7, numeral 6A designates movable contact provided on the movable contactor 6, a numeral 6B designates an arc horn provided at the end of the movable contactor 6, numeral 8 designates a fixed contactor provided facing the movable contactor 6 to feed an electric current, numeral 8A designates a fixed contact provided on the fixed contactor 8, and numeral 8B designates a terminal portion of the fixed contactor 8.

The arc horn 6B may be formed integrally with the movable contactor 6.

Numeral 9 designates a screw for the terminal part to connect the main body of an electromagnetic contactor to an outer electric circuit, numeral 10 designates a base to which the fixed contactor 8 is fitted, and numeral 11 designates a cover for covering the upper surface of the electromagnetic contactor, in which arc extinguishing metallic plates 13 made of a magnetic substance are provided to extinguish an arc 12 produced between the fixed contact 8A and the movable contact 6A. The arc extinguishing metallic plates 13 are arranged vertically in multi-stage, with predetermined distances, in parallel to each other and above the fixed contactor 8 so as to face the movable contactor 6.

Numeral 15 designates a commutation plate provided above the movable contactor 6. In FIG. 1, only the right portion from the center line of the switch is shown in cross-section because the right and left portions are symmetric.

The switch has the construction mentioned above. Accordingly, when the operating coil 4 of the electromagnetic contactor is rendered inactive, the movable iron core 3 is separated from the fixed iron core by means of the trip spring although it is not shown in the Figures.

Accordingly, the cross bar 5 is rendered to be a state as shown in FIG. 1, and the fixed contact 8A is separated from the movable contact 6A to thereby produce the arc 12 therebetween.

The arc 12 makes progress as shown in FIG. 2. Namely, it is attracted to the arc extinguishing metallic plates 13; it is stretched to be an arc 12A; then takes the form of an arc 12B and an arc 12C successively; the leg of the arc 12C on the arc horn 6B is transferred to the commutation plate 15; the arc 12 finally takes the form of an arc 12D; and it is cooled and extinguished by the arc extinguishing metallic plates 13.

In the conventional switch having the above-mentioned construction and operations, the arc extinguishing metallic plates 13 of the magnetic substance are positioned apart from a position where the arc is produced at the initial stage. Accordingly, there was tendency that the rising speed of an arc voltage at the initial stage 5 is low. Accordingly, the current limiting ability is poor with the result that arc energy becomes large and the breaking ability is also poor.

DISCLOSURE OF INVENTION

The object of the present invention to eliminate the above-mentioned problems and to provide a switch having excellent current limiting ability and current breaking ability.

The present invention serves to provide a switch comprising a fixed contact joined to a fixed contactor, a movable contact joined to a movable contactor to face the fixed contact, a plurality of arc extinguishing metallic plates arranged with predetermined distances and in parallel to the fixed contactor at the side of the end portion of the mavable contactor, and a commutation plate placed at the opposite side of the fixed contactor so as to interpose the movable contactor, the switch being characterized in that one free end of the arc extinguishing metallic plates is extended in the direction of the movable contactor, and the free end of the extension is cut so that the movable contact is permitted to move therethrough so as to be brought into contact with the fixed contact.

In accordance with the present invention, an arc is rapidly attracted to the arc extinguishing metallic plates close to the fixed contactor or the commutation plate to thereby increase the rising speed of an initial arc voltage or an arc voltage.

BRIEF DESCRIPTION OF THE DRAWINGS

Various other objects, features and attendant advantages of the present invention will be more fully appreciated as the same becomes better understood from the following detailed description when considered in connection with the accompanying drawings in which like references characters designate like or corresponding parts throughout the several views and wherein:

FIG. 48 is a cross-sectional view of an important part of another embodiment of the present invention to illustrate arc extinguishing operation;

FIG. 49 is a diagram showing the operation of the embodiment shown in FIG. 48;

FIG. 50*a* is a diagram showing the shape of an embodiment of the arc extinguishing metallic plate;

FIG. 50*b* is a diagram showing the shaped of another embodiment of the arc extinguishing metallic plate;

BEST MODE OF THE PRESENT INVENTION

Figure 1:
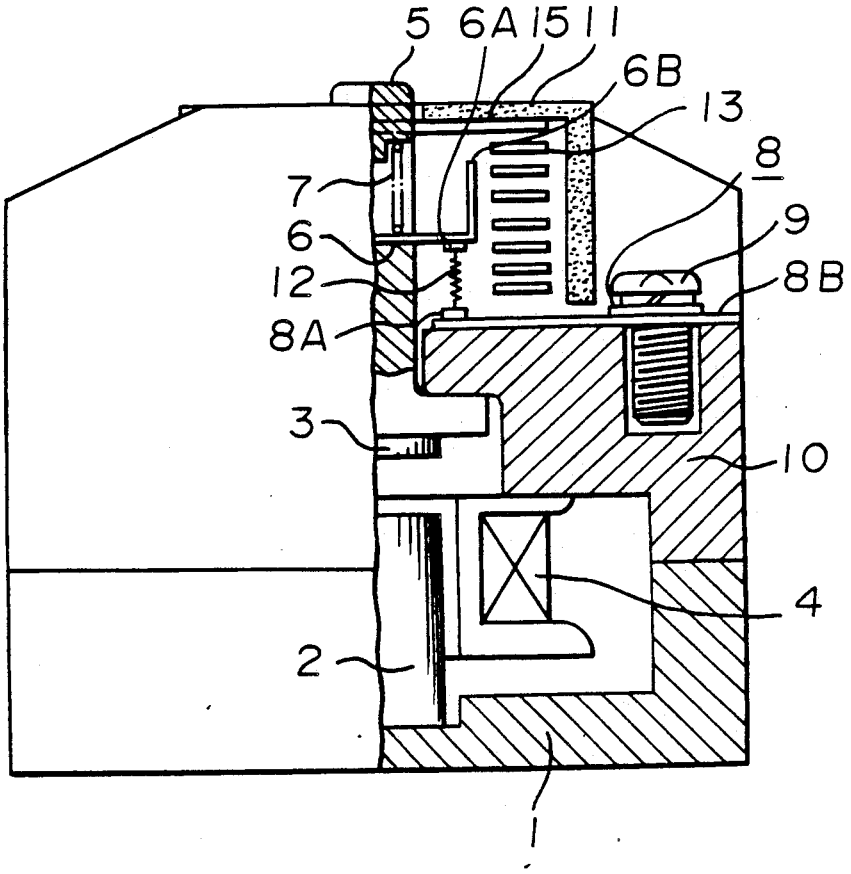
FIG. 1 is a vertical cross-sectional view of a part of a switch as a prior art technique.
Figure 2:
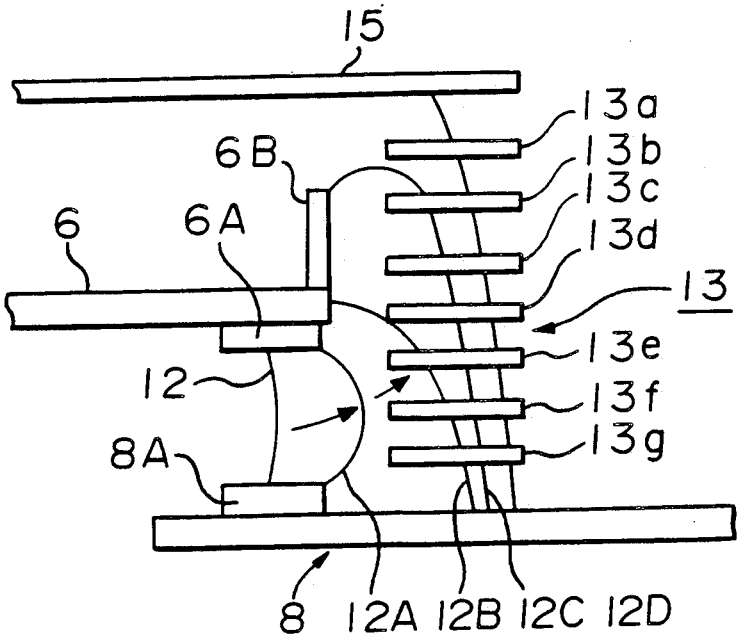
FIG. 2 is a cross-sectional view of an important part of the switch to illustrate arc extinguishing operation.

In the following discussion, embodiments of the present invention will be described with reference to the drawings. Since the embodiments are similar to the conventional switch shown in FIG. 1, only different points will be described. The construction in the outline is similar to that shown in FIG. 1, and therefore description of it will be omitted.

Figure 3:
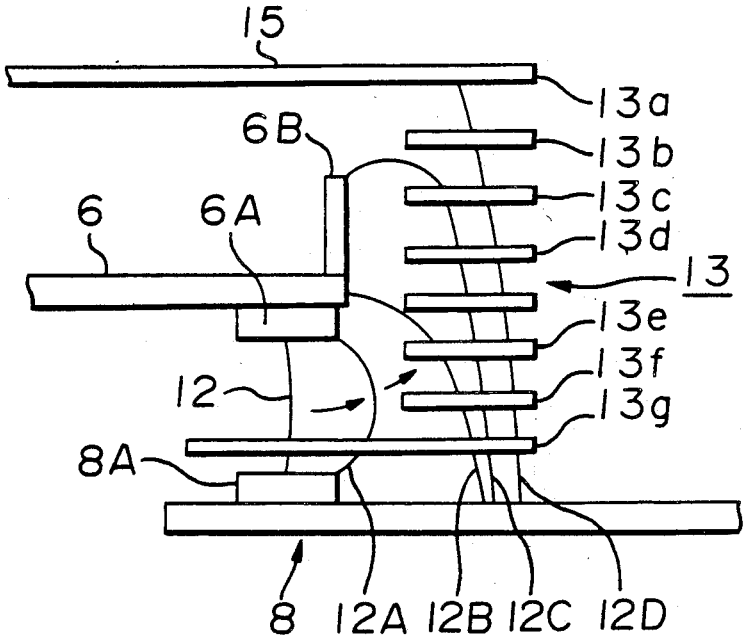
FIG. 3 is a vertical cross-sectional view showing a first embodiment of the switch according to the present invention.

An embodiment of the present invention is shown in FIG. 3. The embodiment as shown in FIG. 3 is different from the conventional switch shown in FIG. 1 in that an arc extinguishing metallic plate 13*g* closest to the fixed contactor 8 among a plurality of arc extinguishing metallic plates 13 is provided with two spaced legs 13*ga* forming a space or an opening therebetween as shown in FIG. 4.

In FIG. 3, an arc 12 is produced as shown in the figure when a movable contact 6A is separated from a fixed contact 8A.

Figure 4:
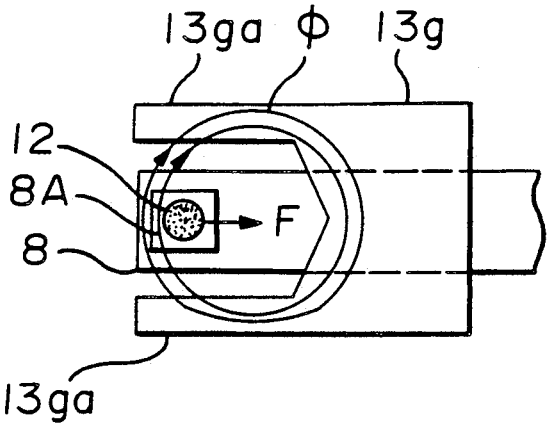
FIG. 4 is a plan view showing a relation of an arc extinguishing metallic plate to a fixed contactor.

Since a magnetic flux $\phi$ is formed around the arc 12 as shown in FIG. 4, the arc 12 is received a force in the direction indicated by an arrow mark F. However, since the legs 13*ga* are provided in the arc extinguishing metallic plate 13*g*, the force F becomes strong and the arc 12 is easily elongated, whereby the rising speed of an arc voltage at the initial stage is increased.

Namely, in the present invention, the rising speed of an arc resistance is increased to thereby increase the current limiting ability. Thus, the arc 12 produced between the both contacts progresses in such a manner that as shown in FIG. 3, it takes the form of an arc 12A in a short time; the arc 12A is attracted to the arc extinguishing plates other than the plate 13*g* to take the form of an arc 12B and an arc 12C successively; and finally, it takes the form of an arc 12D, during of which the arc is cooled and extinguished by the arc extinguishing metallic plates 13.

Thus, since the driving of the arc just after the generation of the arc and the shift of the arc from the state of the arc 12C to the state of the arc 12D are satisfactorily carried out, time for current interruption is shortened. Also, the current limiting ability is increased as described before, whereby arc energy is reduced at the time of the current interruption, and therefore, it is possible to interrupt a large electric current.

Figure 5:
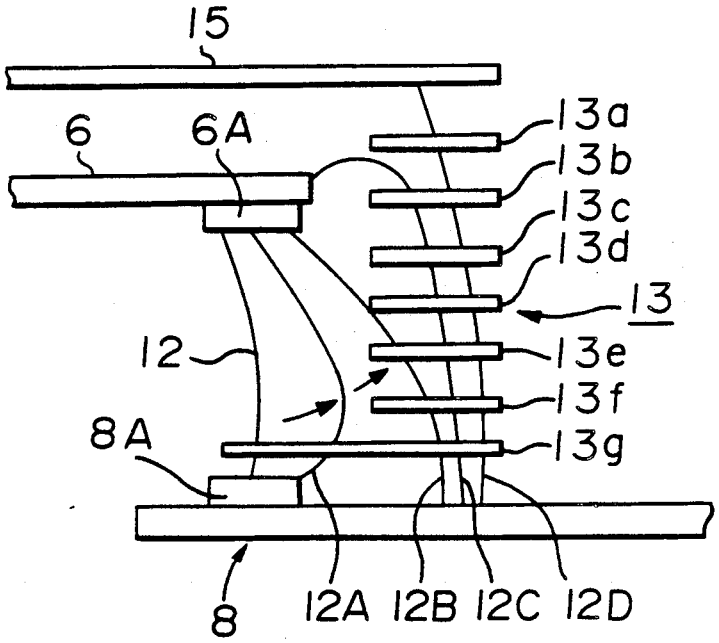
FIG. 5 is a cross-sectional view showing a second embodiment of the present invention.

In the above-mentioned embodiment, the arc horn 6B is joined to the end of the movable contactor 6A, however, the arc horn 6B may be formed integrally with the movable contactor 6A. Further, the arc horn 6B may be omitted as shown in FIG. 5.

Figure 6:
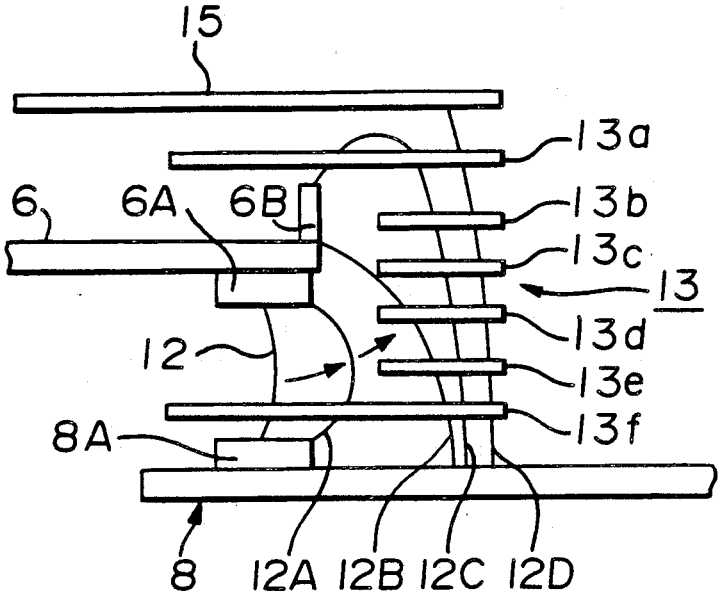
FIG. 6 is a cross-sectional view showing an important part of another embodiment of the present invention.

In the case of the apparatus described with reference to FIG. 3, only the arc extinguishing metallic plate 13*g* closest to the fixed contactor 8 is extended to the upper part of the fixed contact. However, it is possible to construct in such a manner that an arc extinguishing metallic plate 13*a* closest to the commutation plate 15 have the same length as an arc extinguishing metallic plate 13*f* as shown in FIG. 6.

The arc extinguishing operation of an arc extinguishing structure in the apparatus will be described with reference to FIG. 6. The arc 12 is produced between the movable contact 6A and the fixed contact 8A in the same manner as the switch of the above-mentioned embodiment. The arc 12 is elongated by and attracted to the arc extinguishing metallic plate 13*a* made of a magnetic substance in addition to the arc extinguishing metallic plate 13*f* of the magnetic substance to become an arc 12A. The behavior of the arc is the same as described before.

Figure 7:
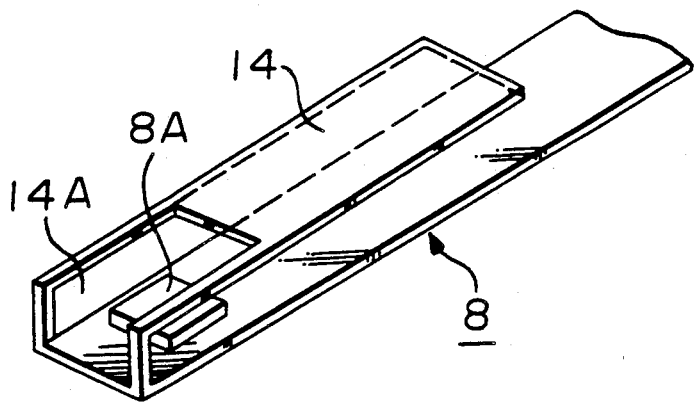
FIG. 7 is a perspective view of the fixed contactor having a part modified according to the present invention.

In this case, the arc horn 6B may be omitted, and the fixed contactor 8 may be provided with an arc runner 14 as shown in FIG. 7.

In the embodiment shown in FIG. 7, the arc runner 14 which is bent in an inverse L-shape is electrically connected to the end part of the fixed contactor 8 on the side of the fixed contact 8A, and further, a notched portion 14A is formed in the bent portion of the arc runner 14 so that the movable contactor 6 is passed through it to come in contact with the fixed contact 8A.

The arc extinguishing structure of the device will be described with reference to FIG. 8. When the arc 12 is produced between the movable contact 6A and the fixed contact 8A, the lower leg of the arc 12 on the fixed contact 8A is easily transferred to the arc runner 14 to take the form of an arc 12A because the arc runner 14 is provided at a higher position than the surface of the fixed contactor 8.

Figure 8:
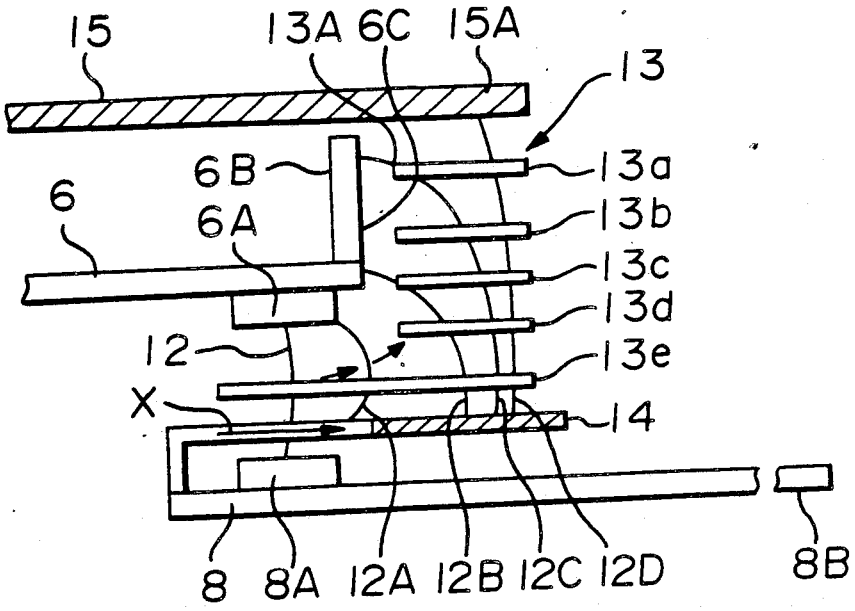
FIGS. 8 and 9 are respectively cross-sectional views of other embodiments of the present invention.

When the lower leg of the arc 12 is transferred to the arc runner 14, an electric current flows in the arc runner 14 in the direction of an arrow mark X in FIG. 8, whereby the arc 12A is further urged toward a terminal portion 8B in the fixed contactor.

The upper leg of the arc 12A is transferred from the movable contact 6A to the end of the movable contactor 6 to be attracted to the arc extinguishing metallic plates 13, and the lower leg is moved on the arc runner 14 by arc extinguishing plates 13*c*–13*e* among the arc extinguishing metallic plates 13.

Then, the upper leg of the arc 12B transferred to the movable contactor 6 is driven by the arc extinguishing metallic plates 13, and it is upwardly driven by a magnetic field which produces an electric current flowing in the arc runner 14 so that the arc is transferred from the fixed contactor 6 to the arc horn 6B to move toward the upper part of the arc horn 6B to thereby reach the upper end portion of the arc horn 6B.

The arc 12C extended from the upper end portion of the arc horn 6B through the arc extinguishing metallic plates 13 reaches the arc runner 14 through the whole of the arc extinguishing plates 13*a*–13*e* of the arc extinguishing metallic plates.

The upper leg of the arc 12C is transferred to the commutation plate 15; it is moved on the commutation plate 15 in the outer direction (on the right hand in the figure) and it traverses the whole of the arc extinguishing plates 13*a*–13*e* of the arc extinguishing metallic plates 13 to become the arc 12D which communicates the arc runner 14, and it is extinguished.

Figure 9:
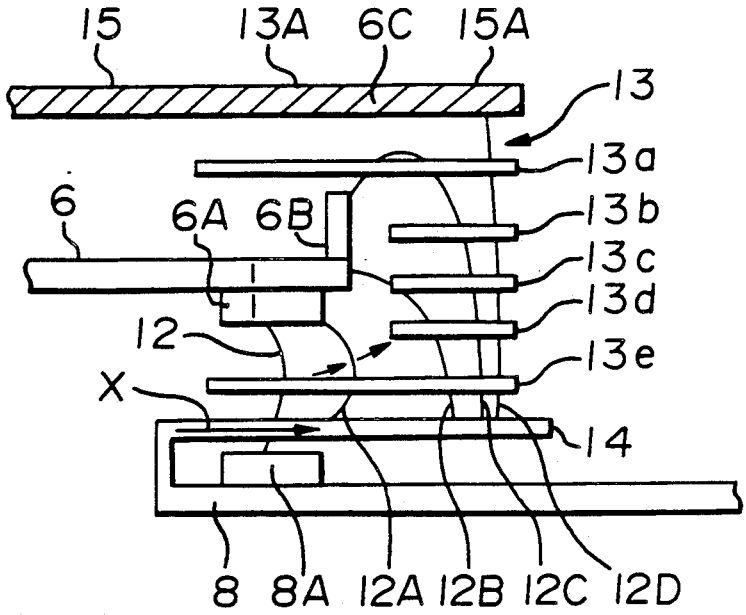

Thus, by providing the arc runner 14, the driving of the arc 12 is further accelerated, and accordingly, both of the current limiting ability and the current breaking ability are further increased. In the device described with reference to FIG. 8, only the arc extinguishing metallic plate 13*e* closest to the fixed contactor 8 is extended to the upper portion of the fixed contact. However, it is possible to so constructed that the arc extinguishing metallic plate 13*a* has the same length as the arc extinguishing metallic plate 13*e* as shown in FIG. 9.

The arc extinguishing operation is generally similar to that in FIG. 8. Namely, the arc 12 is attracted to the arc extinguishing metallic plate 13*a* in addition to the arc extinguishing metallic plate 13*e* of the magnetic substance. Accordingly, the arc takes a further elongated form to thereby accelerate the movement of the arc. The subsequent behavior of the arc is the same as described before.

Another embodiment will b described with reference to FIG. 10. The embodiment shows an example in which the arc horn 6B and the arc extinguishing metallic plates 13 are used for a switch having a fixed contactor 8 in the form of . An arc 12 produced is not only attracted to the arc extinguishing metallic plate 13*f* of the magnetic substance but also is driven by a magnetic field formed by an electric current flowing in the fixed contact 8 (an arrow mark X in FIG. 10). Accordingly, the lower leg of the arc 12 is easily transferred from the fixed contact 8A to the fixed contactor 8 to reduce the wearing of the fixed contact 8A, and at the same time, an arcing time is shortened because the arc 12 is strongly urged. Thus, currnet breaking ability is further improved.

Figure 10:
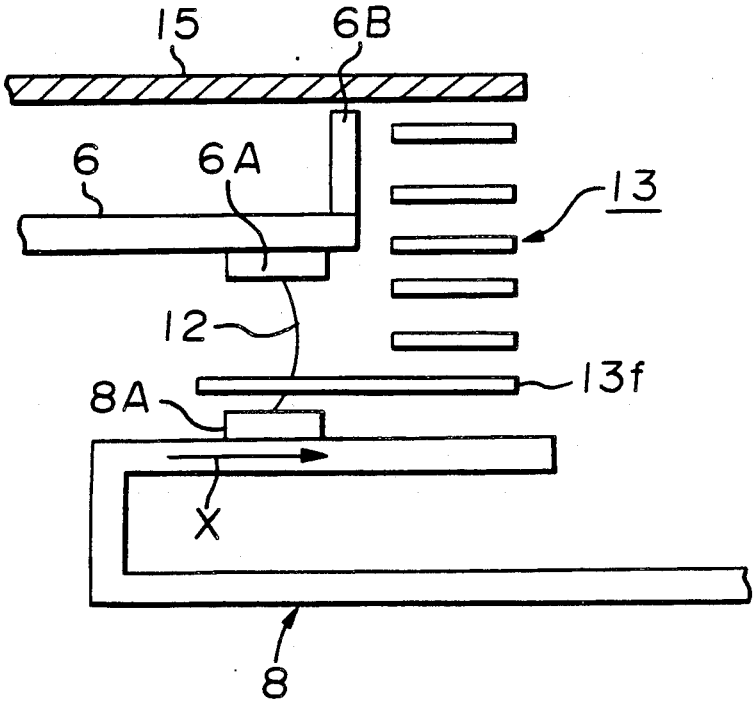
FIGS. 10 to 12 are respectively cross-sectional views of other embodiments of the present invention.
Figure 11:
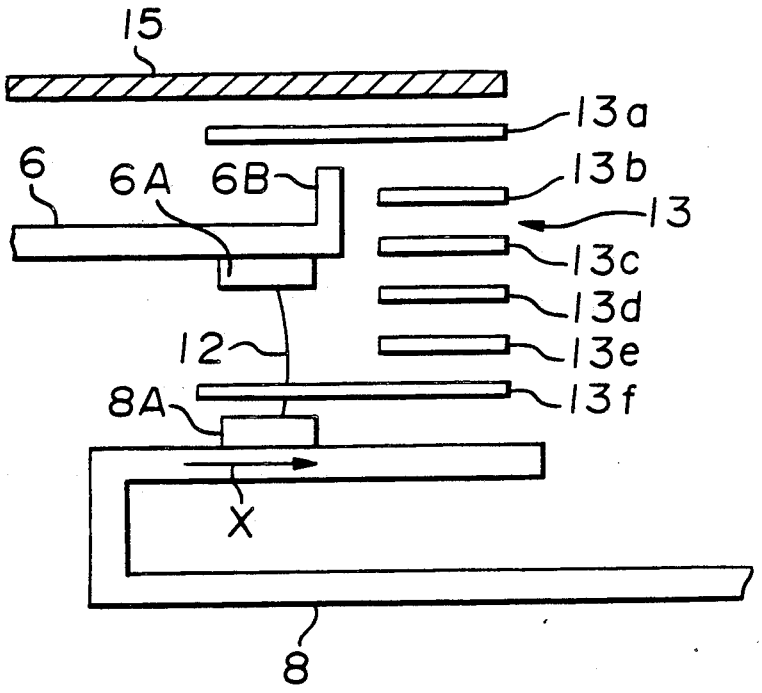

FIG. 11 shows a modification of a part of FIG. 10, in which the length of the arc extinguishing metallic plate 13*a* near the commutation plate 15 as well as the arc extinguishing metallic plate 13*f* placed near the fixed contactor is elongated.

In this case, the same function as the previously mentioned embodiments can be expected.

Figure 12:
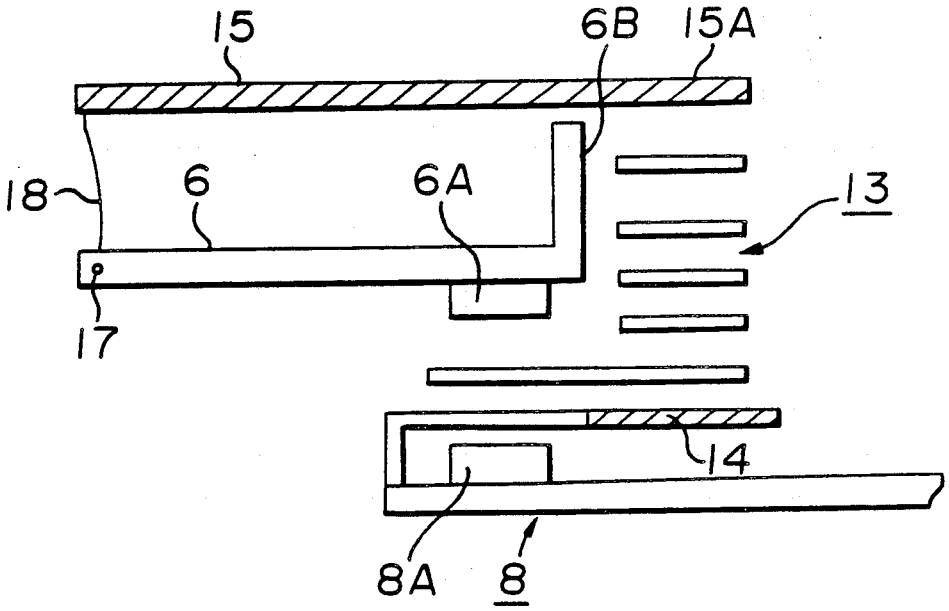
Figure 13:
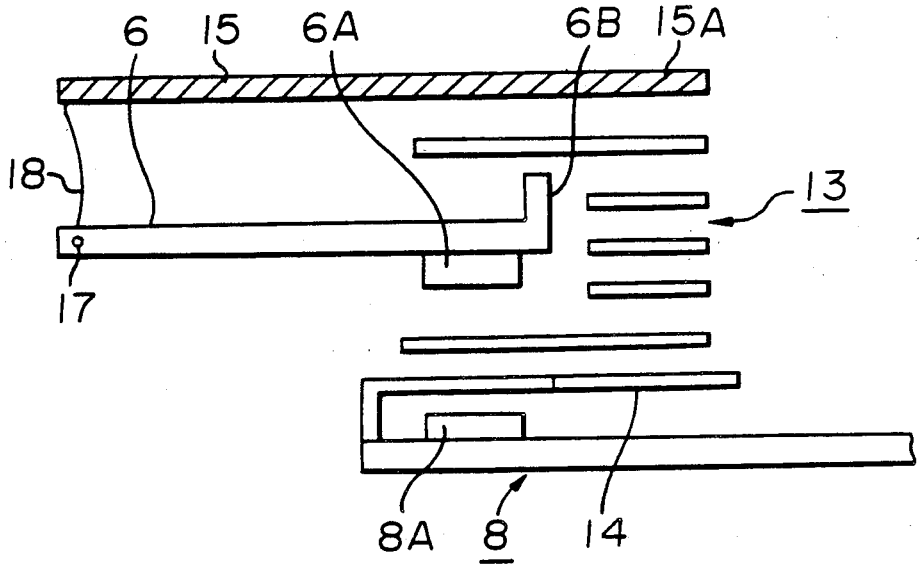
FIG. 13 is a cross-sectional view of a part of a movable contactor as an example in which an improvement is added according to the present invention.

FIGS. 12 and 13 show the case in which the present invention is applied to a circuit breaker for wiring, in which a reference numeral 17 designates a pivotal shaft, and a numeral 18 designates a twisted wire through which the movable contactor 6 is electrically connected to the commutation plate 15. In this case, the same function can be obtained in the same manner as the previously mentioned embodiments.

In FIGS. 12 and 13, it is apparent that the function of the present invention can be obtained without the arc runner 14.

Figure 14:
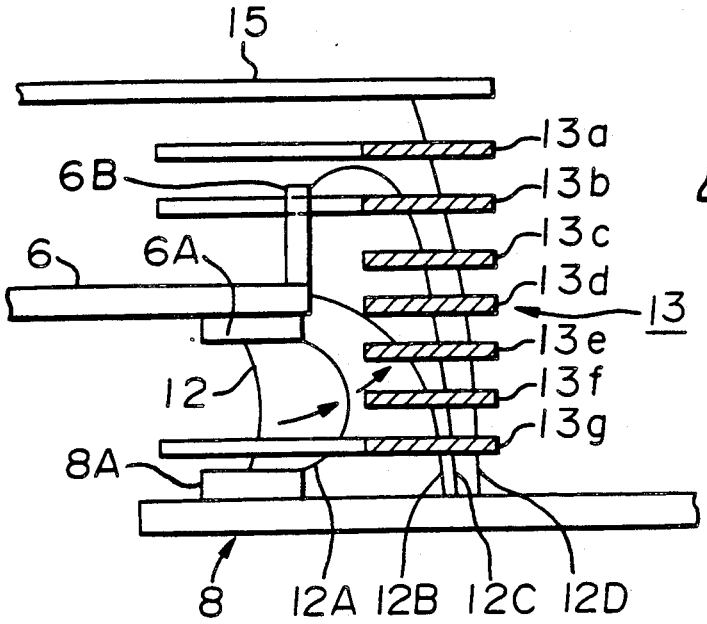
FIG. 14 is a cross-sectional view showing another embodiment of the present invention.

An embodiment as shown in FIG. 14 is provided with the arc extinguishing metallic plates 13*a* and 13*b* placed between the movable contact 6A and the commutation plate 15, which have the same shape as the arc extinguishing metallic plate 13*g*, namely, they are provided with legs as indicated by a numeral 139*a* in FIG. 4.

In the case of FIG. 14, the leg of the arc 12*c* extended from the arc horn 6B is strongly attracted to the arc extinguishing metallic plates 13*a*, 13*b* of the magnetic substance; accordingly, the rising speed of an arc voltage is accelerated and current limiting ability and current breaking ability are improved.

The arc extinguishing metallic plate with the legs 13*fa* placed between the movable contact 6A and the commutation plate 15 may be a single or plural.

Figure 15:
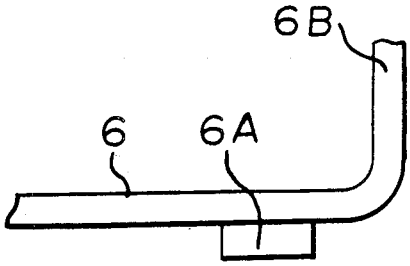
FIG. 15 is a side view for illustrating an embodiment of the present invention in which the shape of an arc horn is changed.

In the embodiments described above, the arc horn 6B is exteded at a right angle from the end of the movable contactor 6. However, it is not limited that it is extended at the right angle as shown in FIG. 15.

Each of the embodiments have been described on the assumption that the present invention is applied to an electromagnetic contactor or a circuit breaker for wiring. However, the present invention can also be applied to an air circuit breaker.

In accordance with the construction of each of the embodiments, both the current breaking ability and the current limiting ability can be improved.

Figure 16:
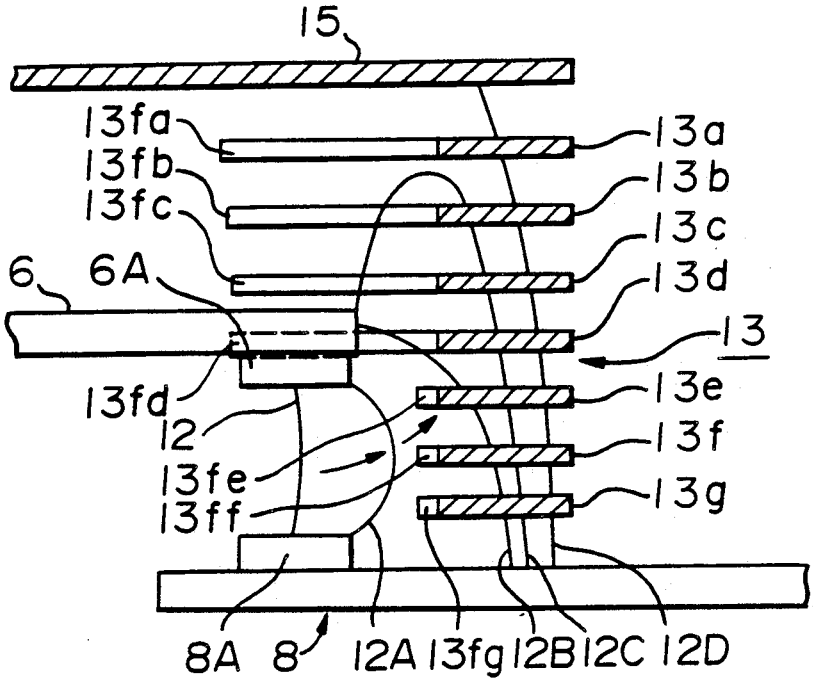
FIG. 16 is a cross-sectional view of an important part of another embodiment of the present invention for illustrating arc extinguishing operation.
Figure 17:
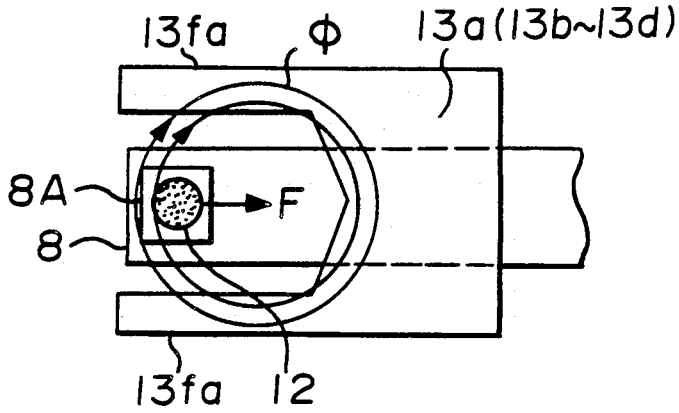
FIG. 17 is a diagram showing in detail the operation of the embodiment shown in FIG. 16.
Figure 18:
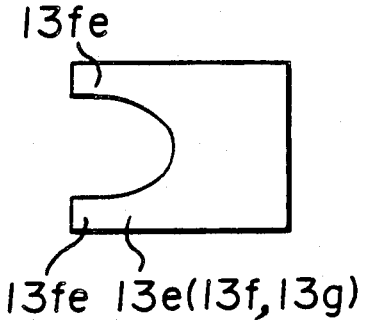
FIG. 18*a* is a view showing the shape of an arc extinguishing metallic plate.
FIG. 18*b* is a view showing the shape of another embodiment of the arc extinguishing metallic plate.
Figure 18:
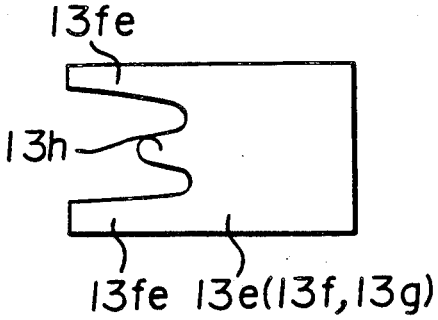

FIGS. 16 to 18 show another embodiment in which a plurality of arc extinguishing metallic plates placed between the commutation plate and the movable contactor are extended to the side of a space in which the movable contactor is movable.

Namely, FIG. 16 is a cross-sectional view of an important part of the embodiment of the present invention to illustrate its arc distinguishing function; FIG. 17 is a diagram showing the operation of the embodiment as shown in FIG. 16 in detail; FIG. 18*a* is a diagram showing an arc extinguishing metallic plate; and FIG. 18*b* is a diagram showing the shape other than the above-mentioned arc distinguishing metallic plate. In FIG. 16, a reference numeral 6 designates a movable contactor, 6A designates a movable contact, 8 designates a fixed contactor, 8A designates a fixed contact and 15 designates a commutation plate placed above the movable contactor 6. A numeral 13 designates arc distinguishing metallic plates consisting of a plurality of arc distinguishing metallic plates 13*a* to 13*g* which are arranged with predetermined distances and in parallel to the fixed contactor 8 and at the side of the movable contactor 6. Among the arc extinguishing metallic plates 13, the arc extinguishing metallic plates 13*a* to 13*d* placed between the commutation plate 15 and the movable contactor 6 are respectively provided with a pair of legs 13*fa*–13*fd* whose ends are extended to the side part of the space in which the movable contactor 6 is movable. Among the arc extinguishing metallic plates 13, the other arc extinguishing metallic plates 139 and 13*f* placed between the movable contactor 6 and the fixed contact 8 are respectively provided with a pair of short legs 13*fe*–13*fg* whose end portions reach near the end portion of the movable contactor 6 as shown in FIG. 18*a*. FIG. 18*b* shows a modification of the arc extinguishing metallic plates 13*e* and 139 shown in FIG. 18*a*, in which a mountain-like projection 13*h* is formed at the center of the edge portion of each of the arc distinguishing metallic plates 13*e* and 13*f*.

The reason why the arc distinguishing metallic plates 13*e*–13*g* have the short legs 13*fe*–13*fg* is that if the longer legs 13*fa* as in the arc extinguishing metallic plate 13*a* is formed, the arc produced between the movable and fixed contacts 6a, 8a is transferred to the side part of the arc extinguishing metallic plates 13 to cause thermal deterioration of an insulating material between the arc extinguishing plates to thereby cause inability of breaking or losing function. Namely, an insulation resistance between the arc distinguishing plates becomes zero, and there is a drawback that the arc 12 is not transferred to the commutation plate 15.

In the switch constructed as above-mentioned, when the movable contact 6A is separated from the fixed contact 8A, a arc is produced between the movable contact 6A and the fixed contact 8A as shown in FIG. 16. A magnetic flux is generated around the arc 12, and a force urges the arc 12 toward the arc extinguishing metallic plates 13e and 13f made of the magnetic substance so that it takes the form of an arc 12A. The upper leg of the arc 12A is transferred from the movable contact 6A to the end portion of the movable contactor 6 and the arc 12 is drawn to the arc extinguishing metallic plates 13d–13g, whereas the lower leg is moved on the fixed contactor 8 to become an arc 12B. The upper leg of the arc 12A transferred to the movable contactor 6 causes a magnetic flux $\phi$ around the leg portion which receives a force as indicated by an arrow mark F. Since the arc extinguishing metallic plates 13a–13d are respectively provided with the legs 13fa–13fd extending to the side of the movable contactor 6, the force F is so strong that the arc 12B is urged in the direction of F and easily extendable vertically. Accordingly, the rising speed of an arc voltage at the initial stage is fast. Namely, since the rising speed of an arc resistance becomes relatively fast, current limiting ability is improved. Thus, when the arc 12B is urged in the F-direction and the upper leg of the arc 12B is extended upwardly, the arc is transferred from the movable contactor 6 to the arc extinguishing metallic plates 13b, 13c to become an arc 12C. The arc 13C reaches the fixed contactor 8 via the arc extinguishing metallic plates 13d–13g. Then, the upper leg of the arc 12C is moved on the commutation plate 15 in the outer direction (on the right hand in the figure) via extinguishing metallic plate 13a; thereafter, the arc traverses all of the arc extinguishing metallic plates 13a–13g constituting the arc extinguishing metallic plates 13; and finally becomes an arc 12D which communicates with the fixed contactor 8 to be extinguished. As described above, since the plurality of arc extinguishing metallic plates 13a–13d placed between the commutation plate 15 and the movable contactor 6 are respectively provided with legs 13fa–13fd extending to the side of the space in which the movable contactor 6 is movable, urging of the arc to the commutation plate 15 is satisfactorily obtained even when the arc is produced. Accordingly, the time required for current interruption is shortened and current limiting ability is also improved, whereby arc energy at the time of interruption is decreased. It is possible to interrupt a large electric current. Further, since the legs 13fa–13fd provided in the arc extinguishing metallic plates 13a–13d are extended only to the side of the movable contactor 6, the structure is minimized in the same manner as the above-mentioned embodiments.

Figure 19:
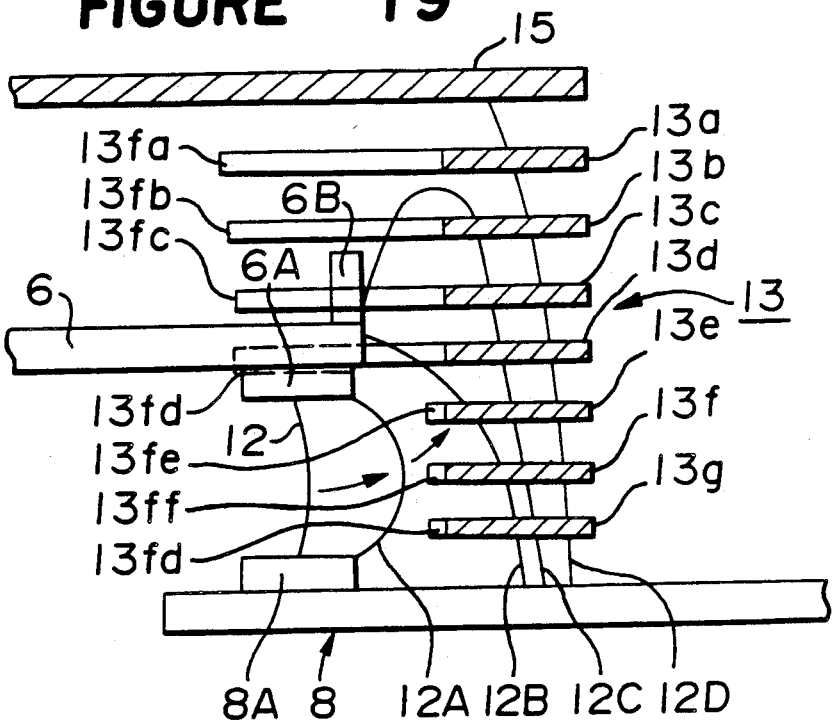
FIG. 19 is a cross-sectional view of an important part of another embodiment of the present invention for illustrating arc extinguishing operation.

FIG. 19 is a cross-sectional view of an important part of another embodiment of the present invention to illustrate arc extinguishing function.

In the embodiment, an arc horn 6B is formed at the end of the movable contactor 6. The other structure is the same as that of the embodiment shown in FIG. 16. By providing the arc horn 6D, the commutation of the arc to the commutation plate 15 is further accelerated.

Figure 20:
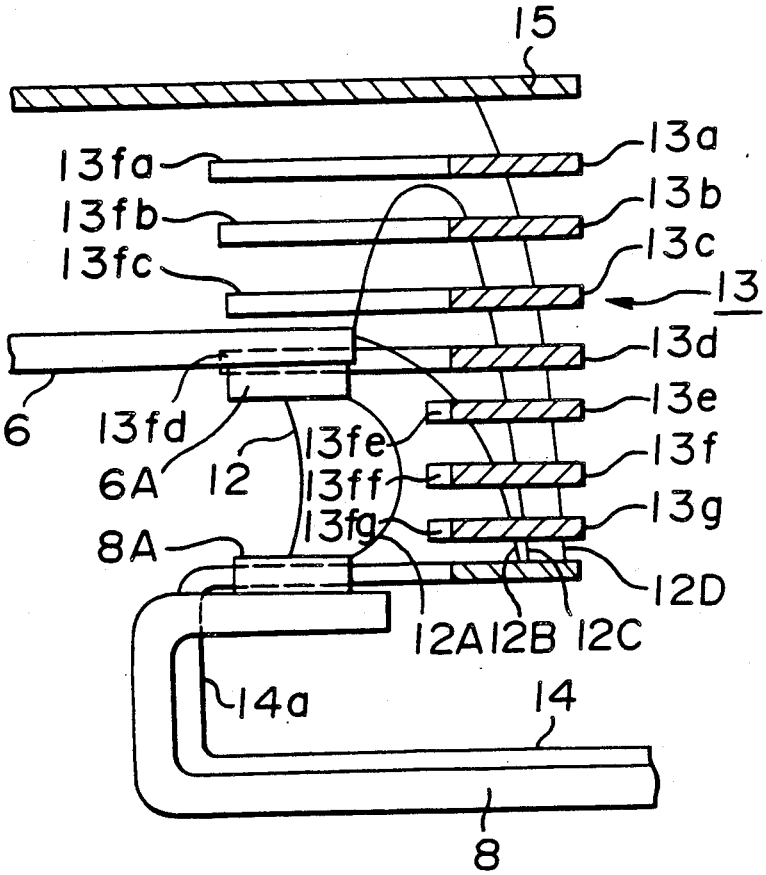
FIG. 20 is a cross-sectional view of an important part of another embodiment of the present invention for illustrating arc extinguishing operation.

FIG. 20 is a cross-sectional view of an important part of still another embodiment of the present invention to illustrate arc extinguishing function.

In the embodiment, an arc runner 14 is provided with a pair of legs 14a formed by bending it in a shape of , which are positioned at an end of the fixed contact 8A of the fixed contactor 8, and the base portion of the arc runner 14 is determined to be in parallel to the arc extinguishing metallic plates 13.

In the embodiment, when an arc 12 is produced between the movable contact 6A and the fixed contact 8A, the arc is attracted to the arc extinguishing metallic plates 13e–13g to become an arc 13A by the function of elongation. In this case, since the arc runner 14 is placed at a position higher than the surface of the fixed contactor 8, the lower leg of the arc 12 in contact with the fixed contact 8A is easily transferred onto the arc runner 14 to thereby take the form of an arc 12A. When the lower leg of the arc 12 is transferred onto the arc runner 14, the arc runner 14 is excited by a magnetic flux produced around the arc 12A, as the result that the arc 12A is further urged toward the terminal portion of the fixed contactor 6. The upper leg of the arc 12A is transferred from the movable contact 6A to the end portion of the movable contactor 6 and it is attracted to the arc extinguishing metallic plates 13. Then, the lower leg is moved on the arc runner 14 via the arc extinguishing metallic plates 13e–13g among the arc extinguishing metallic plates to take the form of an arc 12B. Then, the upper leg of the arc 12B transferred on the movable contactor 6 is further transferred from the movable contactor 6 to the arc extinguishing metallic plates 13b, 13c to become an arc 13C in the same manner as the above-mentioned embodiments. The arc 12C reaches the arc runner 14 via the arc extinguishing metallic plates 13b–13g. The upper leg of the arc 12C is transferred onto the commutation plate 15 via the arc extinguishing metallic plate 13a, then it is moved on the commutation plate 13 outwardly (on the right hand on the drawing) to take the form of an arc 12D communicating with the arc runner 14 after it traverses all of the arc extinguishing metallic plates 13a–13g; thus, the arc is extinguished. Thus, by providing the arc runner 14, the urging of the arc 12 can be accelerated, and accordingly, both the current limiting ability and current breaking ability can be further increased.

Figure 21:
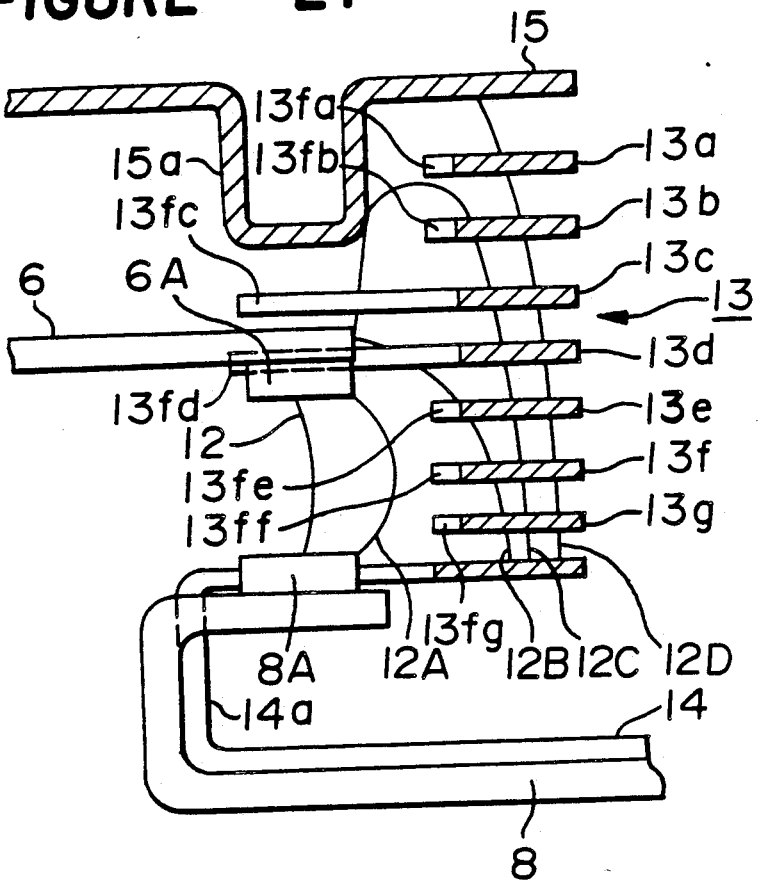
FIG. 21 is a cross-sectional view of an important part of another embodiment of the present invention to illustrate arc extinguishing operation.

FIG. 21 is a cross-sectional view of an important part of another embodiment of the present invention to illustrate arc extinguishing function.

Of the arc extinguishing metallic plates 13 in the embodiment, two arc extinguishing metallic plates 13c, 13d placed near the movable contactor 6 are respectively provided with a pair of legs 13fc, 13fd which are extended to the side of a space in which the movable contactor 6 is movable. The remaining arc extinguishing metallic plates 13a, 13b, 13e, 13f, 13g are respectively provided with a pair of short legs 13fa, 13fb, 13fe, 13ff, 13fg at the end part of the movable contactor 6. A commutation plate 15 is provided with an end portion 15a in the shape of which comes near the movable contactor 6. Further, there is provided an arc runner 14 having a leg portion 16a formed by bending it in the shape of .

In the embodiment, when an arc is produced between the movable contact 6A and the fixed contact 8A, the arc 12 is attracted to the arc extinguishing metallic plates 13e–13g of a magnetic substance and is elongated. The lower leg of the arc 12 is transferred onto the arc runner 14 to take the form of an arc 12A and urged toward the terminal portion of the fixed contactor 8. The upper leg of the arc 12A is transferred from the movable contact 6A to the end portion of the movable contactor 6, and it is attracted to the arc extinguishing metallic plates 13e–3g. On the other hand, the lower leg is moved on the arc runner 14 via the arc extinguishing metallic plates 13d–13g among the arc extinguishing metallic plates 13 to take the form of an arc 12B. Then, the upper leg of the arc 12B transferred on the movable contactor 6 is easily extendable upwardly since the leg portions 13fc are formed in the arc extinguishing metallic plate 13c and an end portion 15a is formed in the commutation plate 15 so as to close to the movable contactor 6. Accordingly, an arc 12C is formed by the transfer of the upper leg of the arc 12B from the movable contactor 6 to the end portion 15a of the commutation plate 15. The arc 12C reaches the arc runner 14 via the arc distinguishing metallic plates 13d–13g. Then, the upper leg of the arc 12C is moved on the commutation plate 15 outwardly (on the right hand in the figure) to become an arc 12D communicating with the arc runner 14 via all of the arc extinguishing metallic plates 13a–13g and it is extinguished. Thus, by providing the bent portion 15a in the commutation plate 15 which comes close to the movable contact 6 in addition to provision of the arc runner 14, the arc is further accelerated by the upper and lower legs. Accordingly, both the current limiting ability and current breaking ability can be further increased.

As described above, since the embodiments shown in FIGS. 16–21 are provided with the plurality of arc extinguishing metallic plates extending to the side of the space in which the movable contactor is movable, the plurality of plates being placed in the commutation plate and the movable contactor, these arc extinguishing metallic plates are positioned near a position where the arc is produced at the initial stage. Accordingly, there are advantages that a speed of the shifting of the arc to the commutation plate by the attraction of it, i.e. the rising speed of initial arcing is increased; the current limiting ability and the current breaking ability are improved; time for interrupting can be shortened and the wearing of the contacts is minimized. Therefore, the life span is prolonged, and a small-sized device is obtainable.

Figure 22:
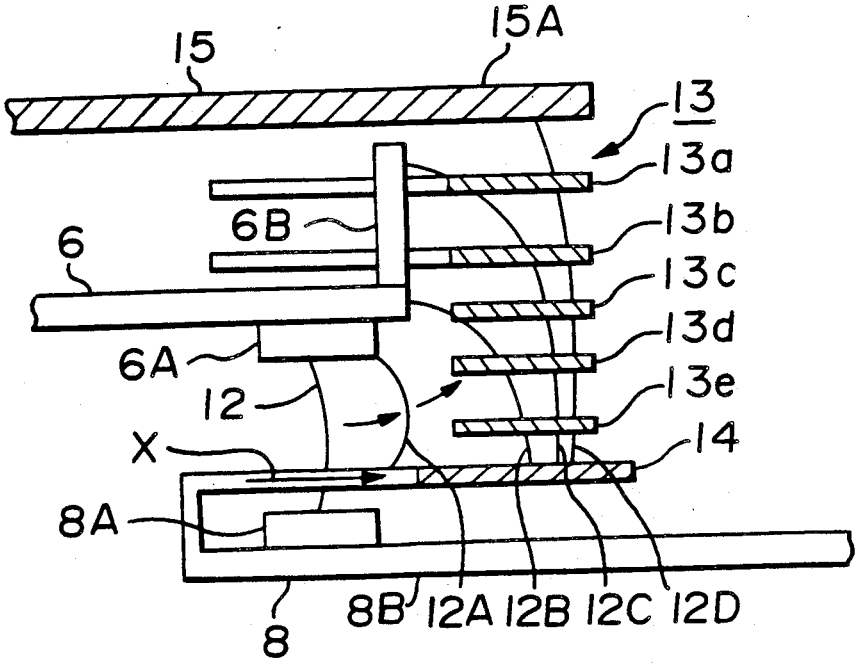
FIG. 22 is a diagram showing another embodiment of the present invention.

FIG. 22 shows still another embodiment of the present invention in which an arc horn 6B is joined to the end of the movable contactor 6A. In this case, a separate element may be used for the movable contactor 6A and the arc horn 6B, or they may be formed in one piece.

The arc extinguishing structure of the device will be described. In the same manner as the embodiments as described before, when an arc 12 is produced between the movable contact 6A and the fixed contact 8A, the arc is attracted to the arc runner 14 with the aid of the arc extinguishing metallic plates 13 of a magnetic substance and is elongated to be an arc 12A.

In this case, since the arc runner 14 is provided at a position higher than the front surface of the fixed contactor 8, the lower leg of the arc 12 on the fixed contact 8A is easily transferred onto the arc runner 14 to take the form of an 12A.

When the lower leg of the arc 12 is transferred onto the arc runner 14, an electric current passes in the arc runner 14 in the direction of an arrow mark X in FIG. 22 so that the arc 12A is furter urged toward the terminal portion 8B of the fixed contactor.

The upper leg of the arc 12A is transferred from the movable contact 6A to the end portion of the movable contactor 6, and the arc 12 is drawn in the arc extinguishing metallic plates 13. On the other hand, the lower leg is moved on the arc runner 14 via the arc extinguishing metallic plates 13c–13d among the metallic plates 13.

Then, the upper leg of the arc 12B transferred on the movable contactor 6 is urged by the arc extinguishing metallic plates 13 and at the same time, it is urged upwardly by a magnetic field formed by an electric current flowing in the arc runner 14; the arc is transferred from the movable contactor 6 on the arc horn 6B to be moved on the arc horn 6B whereby it reaches the end portion of the arc horn 6B.

Then, the arc 12C elongated from the upper end portion of the arc horn 6B via the arc extinguishing metallic plates 13 reaches the arc runner 14 via all of 13a–13e of the arc extinguishing metallic plates 13.

Then, the upper leg of the arc 12C is transferred onto the commutation plate 15 and is moved on the commutation plate 15 outwardly (on the right hand in the figure) and thereafter, it traverses all of the arc extinguishing plates 13a–13e constituting the arc extinguishing metallic plates 13, whereby an arc 12D communicating the arc runner 14 is formed and it is extinguished.

Thus, by providing the arc runner 14, the arc 12 can be urged at a further high speed, whereby both the current limiting ability and current breaking ability can be further increased.

Figure 23:
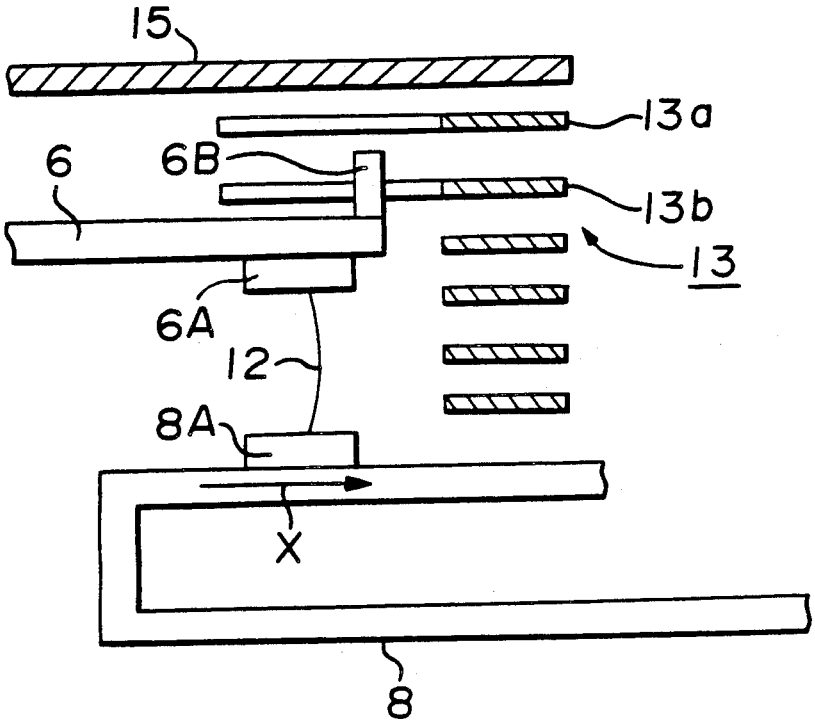
FIG. 23 is a cross-sectional view of another embodiment of the present invention.

Another embodiment will be described with reference to FIG. 23. The embodiment is provided with a fixed contactor 8 having the shape of . An arc 12 produced is not only attracted to the arc extinguishing metallic plates 13 of a magnetic substance, but also is urged by a magnetic field formed by an electric current flowing in the fixed contactor 8 (an arrow mark X in FIG. 23). Accordingly, the lower leg of the arc 12 can be easily transferred from the fixed contact 8A to the fixed contactor 8, whereby the wearing of the fixed contact 8A can be reduced. Further, since the arc 12 is strongly urged, the arcing time is shortened to thereby further improve current breaking ability.

An embodiment shown in FIGS. 24 to 28 is featurized by extending the leg portion of all of the arc extinguishing metallic plates 13 to the side of a space in which the movable contactor 6 is movable.

Namely, all of the arc extinguishing metallic plates 13 are respectively provided with two legs 13ga at the end portion facing the movable contactor 6.

Figure 24:
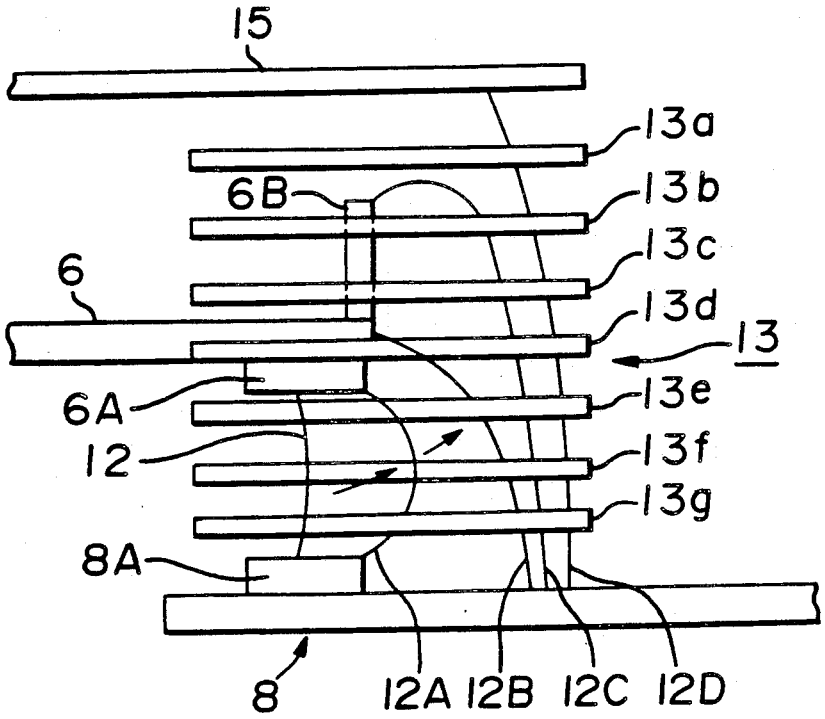
FIG. 24 is a cross-sectional view of an important part of the present invention to illustrate arc extinguishing operation.
Figure 26:
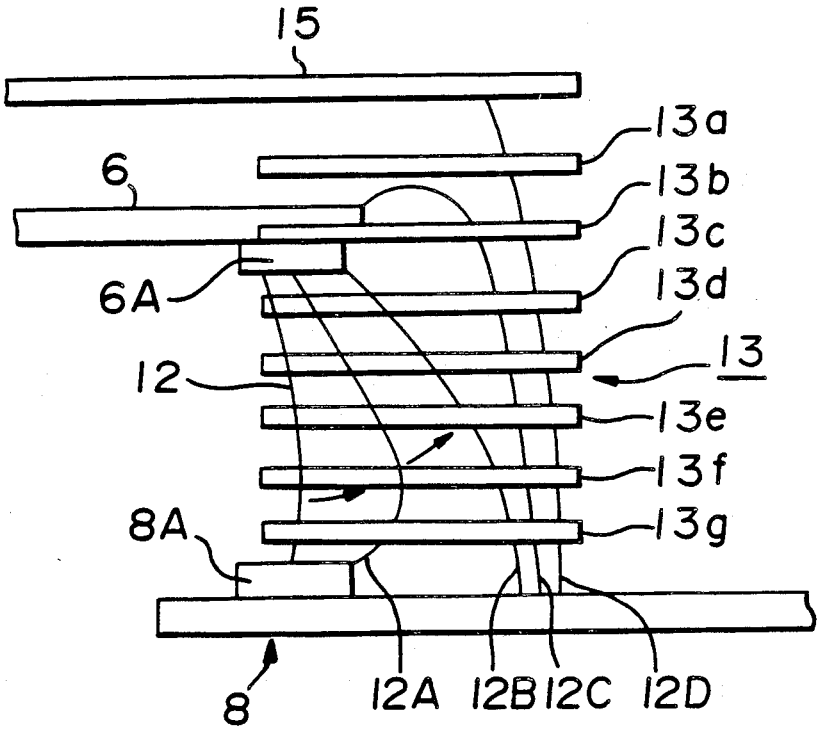
FIG. 26 is a cross-sectional view showing another embodiment of the present invention.
Figure 27:
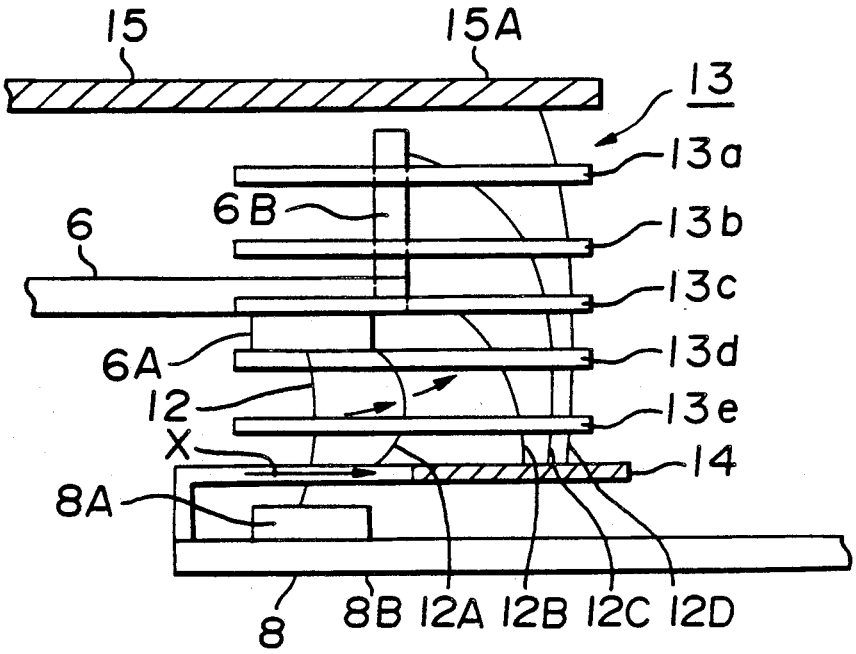
FIG. 27 is a cross sectional view of an embodiment of the present invention in which a fixed contactor partly improved is used.
Figure 28:
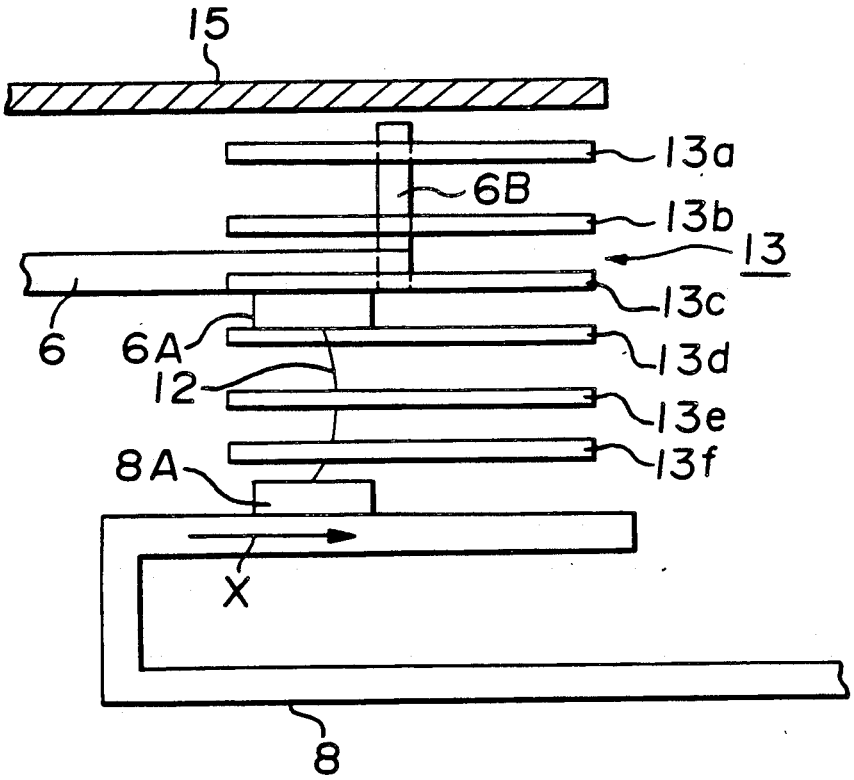
FIG. 28 is a cross-sectional view of an embodiment of the present invention.

The embodiment shown in FIG. 26 is the same as that in FIG. 24 provided that the arc horn 6B is omitted; the embodiment in FIG. 27 is characterized by providing an arc runner 14. The embodiment in FIG. 28 is provided with an arc horn 6B and arc extinguishing metallic plates 13 in a switch having a fixed contactor 8 having the shape of . An arc 12 produced is not only attracted to the arc extinguishing metallic plate 13f of a magnetic substance, but also is urged by a magnetic field formed by an electric current flowing in the fixed contactor 8 (an arrow mark X in FIG. 28). Accordingly, the lower leg of the arc 12 can be easily transferred from the fixed contact 8A to the fixed contactor 8, whereby wear of the fixed contact 8A is reduced and an arcing time is shortened because of a strong urging force imparted to the arc 12, whereby current breaking ability is further improved.

Figure 29:
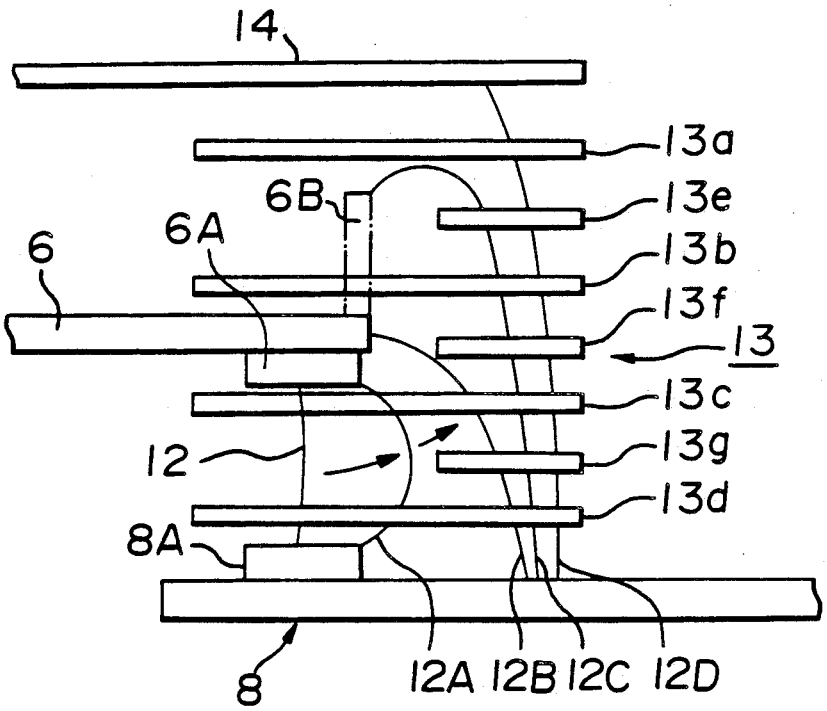
FIG. 29 is a side view showing an important part of another embodiment of the present invention.

In an embodiment as shown in FIG. 29, long arc extinguishing metallic plates 13*a*, 13*b*, 13*c*, 13*d* in which leg portions are formed by cutting the central portion of each of the edges and shorter arc extinguishing metallic plates 13*e*, 13*f*, 13*g* are arranged alternately one by one so that the end portion of the longer arc extingushing metallic plates are placed above or below the movable contactor 6. With such construction, the arc is attracted first to the longer one which is near the fixed contact and the movable contactor, and then, is attracted to the shorter one successively to thereby increase attractive effect to the arc. Thus, current breaking ability is improved.

Figure 30:
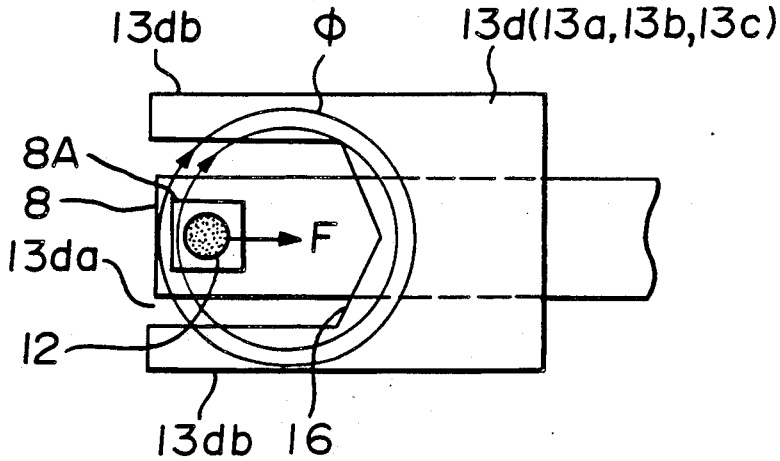
FIG. 30 is a plan view of the important part.

Namely, in the figure, reference numerals 13*a*–13*d* designate the longer arc extinguishing metallic plates. As shown in FIG. 30, the end portion is cut at its central portion to form a pair of leg portions 13*db* at the both edges. Reference numerals 13*e*–13*g* designate the shorter arc extinguishing metallic plates.

The longer arc extinguishing metallic plates 13*a*–13*d* extend to the position overlapping the movable contactor 6, and the movable contact 6*a* and the fixed contact 8*a* are positioned in the cut portion 13*da*. Between the longer arc extinguishing metallic plates 13*a*–13*d* , the shorter arc extinguishing metallic plates 13*e*–13*g* are arranged with predetermined distances with respect to the contacts 6A, 8A. The other ends of the two kinds of the arc extinguishing metallic plates 13*a*–13*d* and 13*e*–13*g* are respectively positioned in the same plane.

In the present invention constructed as described above, when the movable contact 6A is separated from the fixed contact 8A, an arc 12 is produced between the both contacts 6A, 8A as shown in FIG. 29. A magnetic flux $\phi$ is produced around the arc 12 as shown in FIG. 30, and the arc 12 is received a force in the direction of an arrow mark F. Since the leg portions 13*db* are formed in the longer arc extinguishing metallic plates 13*a*–13*d*, the force F is strong, and an attracting effect of the arc extinguishing metallic plates 13*c*, 13*d* is increased to form an arc 12A in a short time. Then, the arc is attracted to the other arc extinguishing metallic plates to take the forms of an arc 12B, 12C and 12D successively, and the arc is cooled and extinguished by the arc extinguishing metallic plates 13.

Thus, in accordance with the embodiment, since the urging of the arc just after the production of the arc and the shift of the arc from the state of the arc 12C to the state of the arc 12D rapidly take place, and current limiting ability and current breaking ability are improved to allow the interruption of a large electric current.

An embodiment as shown in FIGS. 31–34 concerns a switch comprising a plurality of arc extinguishing metallic plates arranged at the end portion of the movable contactor and a commutation plate above the movable contactor in which a projection is formed in each of the arc extinguishing metallic plates at a position slightly inside from the edge portion of it.

Figure 31:
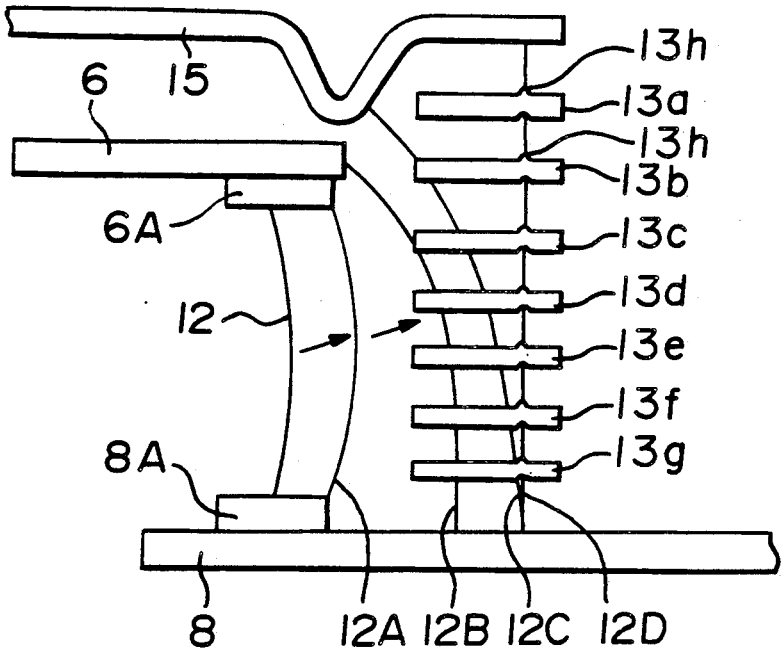
FIG. 31 is a cross-sectional view of an important part of another embodiment of the present invention to illustrate arc extinguishing operation.
Figure 32:
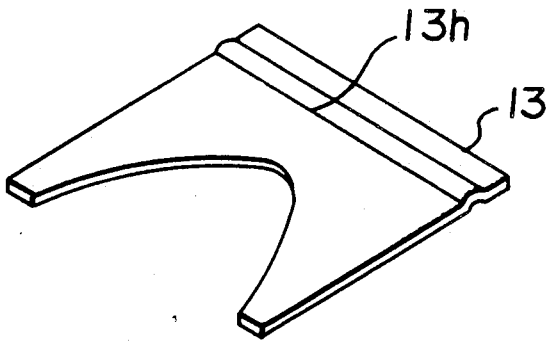
FIG. 32 is a perspective view of the arc extinguishing metallic plate shown in FIG. 31.

Namely, the shape of the arc extinguishing metallic plates 13 used in the embodiment as shown in FIG. 31 is characterized by providing a projection 13*h* extending in the substantially entire width in each of the arc extinguishing metallic plates 13.

In FIG. 31, when the movable contact 6A is separated from the fixed contact 8A, an arc 12 is produced as shown in FIG. 31.

Deformation is caused in the arc 12 by an attracting force resulted by the arc extinguishing metallic plates 13 of a magnetic substance, whereby the arc takes the form of an arc 12A. The upper leg of the arc 12A shifts to the edge portion of the movable contactor 6, and the lower leg is separated from the fixed contact 8A, passing around a part of the arc extinguishing metallic plates 13 to form an arc 12B communicating with the fixed contactor.

Further, the upper leg of the arc 12 moves from the lower part to the upper part of the end portion of the movable contactor 6, and then it becomes an arc 12D. In this case, since the projection 13*h* is formed on the surface of each of the arc extinguishing metallic plates 13, there produces no unstable arc 12D and it is cooled at a predetermined position and is extinguished.

Figure 33:
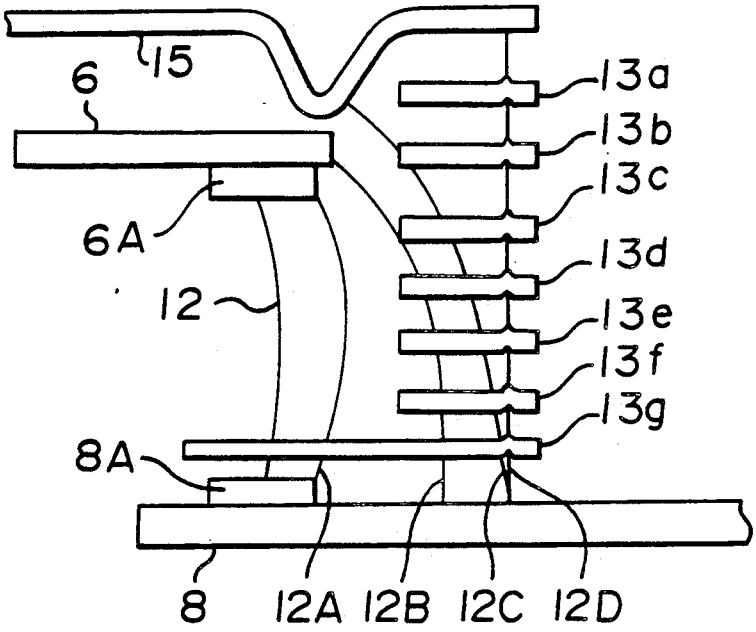
FIG. 33 is a cross-sectional view showing another embodiment of the present invention.

The present invention is not limited to the above-mentioned embodiment but is applicable to a device having the construction as shown in FIG. 33 as a modified form.

Figure 34:
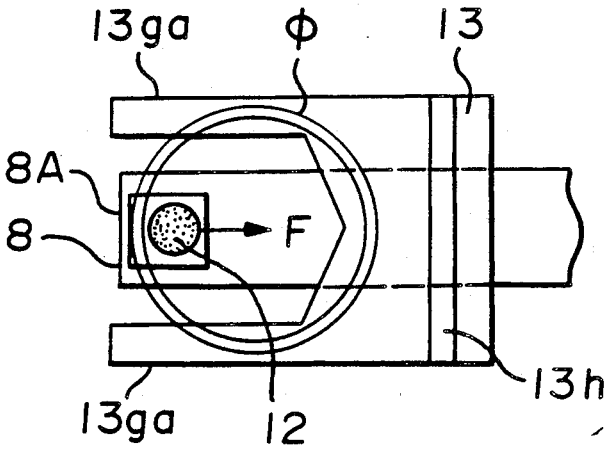
FIG. 34 is a plan view showing a relation of an arc extinguishing metallic plate to a fixed contactor.

Namely, in the embodiment as shown in FIG. 33, it is most important point to modify the shape of the lower most arc extinguishing metallic plate 13*g* among the arc extinguishing metallic plates 13 as shown in FIG. 34.

By constructing it to have such shape, the arc 12 is received a force in the direction as indicated by an arrow mark F because a magnetic flux $\phi$ is produced (FIG. 34) around the arc 12. Since the leg portions 13*ga* are formed in the arc extinguishing metallic plate 13*f* as shown in FIG. 34, the force F is so strong that the arc is easily elongated, whereby the rising speed of an initial arc voltage is increased.

Namely, in the device in the above-mentioned case, the rising speed of an arc resistance is increased to thereby increase current limiting ability.

Accordingly, the arc 12 between the contacts takes the form of an arc 12A in a short time as described with reference to FIG. 31 and it is attracted to the arc extinguishing metallic plates other than 13*f*, and the arc takes the progress of an arc 12B, an arc 12C and finally an arc 12D successively and then, it is cooled by the arc extinguishing metallic plates 13 to be extinguished.

Thus, the urging of the arc just after the production of the arc and the shift of the arc from the state of the arc 12C to the state of the arc 12D are satisfactorily take place. Accordingly, the time required for interruption is shortened and the current limiting ability is increased as described above, whereby arcing energy at an interrupting time is reduced to allow interruption of a large electric current.

In the above-mentioned embodiment, the arc horn 6B is joined to the end of the movable contactor 6A. However, the arc horn 6B may be formed integrally with the movable contactor 6A.

In the case of the device described with reference to FIG. 33, only the arc extinguishing metallic plate 13*g* closest to the fixed contactor 8 is extended over the fixed contact 8A. However, the arc extinguishing metallic plate 13*f* may have the same construction.

As another embodiment, for instance, the fixed contactor 8 provided with the arc runner 14 used for the previously mentioned embodiments may be used.

Further, the arc horn 6B as in each of the previously mentioned embodiments may be provided at the end portion of the movable contactor 6.

In the embodiment as shown in FIGS. 31–34, the projection is provided at a specified position of the arc extinguishing metallic plates. Accordingly, there is caused no unstable arc and the arc is extinguished in a predetermined position, with the result being that there is no damage to an insulating material constituting the outer wall, and both the current breaking ability and current limiting ability can be improved.

Figure 35:
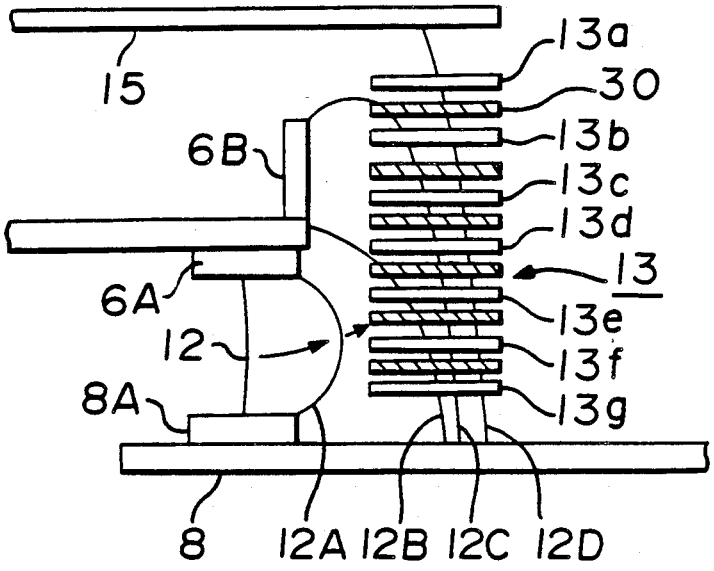
FIG. 35 is a cross-sectional view of an important part of another embodiment of the present invention to illustrate arc extinguishing operation.
Figure 36:
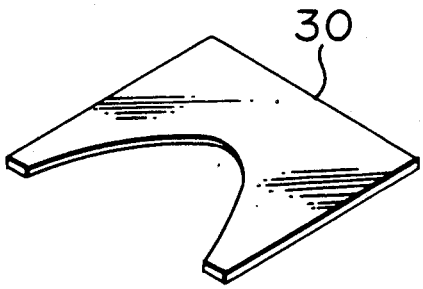
FIG. 36 is a perspective view showing an insulating plate used for the embodiment.
Figure 37:
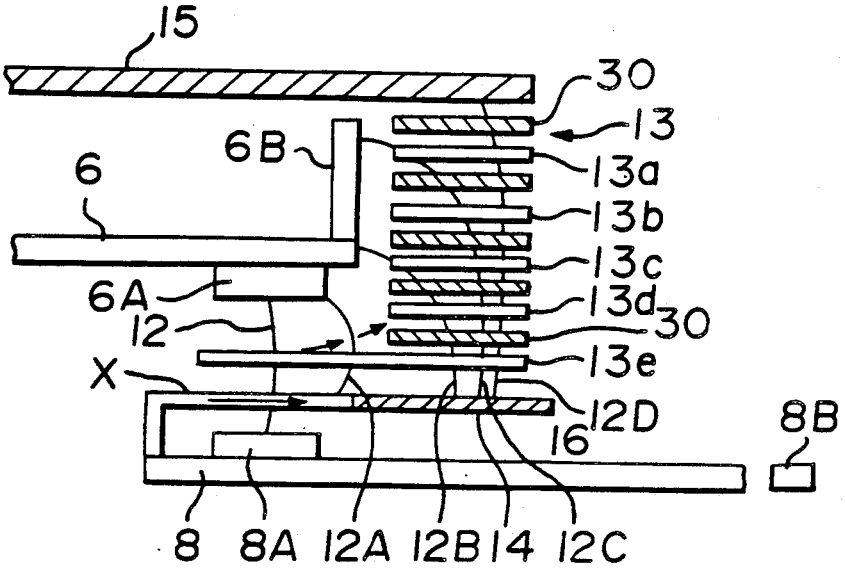
FIG. 37 is a cross-sectional view of an important part of another embodiment of the present invention.

An embodiment of the switch as illustrated in FIGS. 35 and 37 is so constructed that an insulating material having the same shape as the arc extinguishing metallic plates 13 (FIG. 36) is inserted between the arc extinguishing metallic plates 13, whereby the arc is prevented from staying between them to thereby improve current breaking ability.

Namely, in the embodiment shown in FIG. 35, insulating plates as shown in FIG. 36 are interposed between the arc extinguishing metallic plates 13.

In FIG. 35, when the movable contact 6A is separated from the fixed contact 8A, an arc is produced as shown in the figure.

The arc 12 takes such progress that it takes the form of an arc 12A in a short time; then is attracted to the arc extinguishing metallic plates 13 to be an arc 12B, then is transformed into an arc 12C and finally becomes an arc 12D, which is cooled by the arc extinguishing metallic plates 13 to be extinguished.

In this case, since the urging of the arc after the production of the arc and the shift of the arc from the arc 12C to 12D are satisfactorily take place, time required for interruption is shortened and current limiting ability is increased as described before. Accordingly, arc energy at the time of interruption is decreased to allow the interruption of a large electric current.

By arranging insulating plates 30 between the arc extinguishing metallic plates 13, there causes no direct contact of the arc extinguishing metallic plates 13 since the insulating plates 14 are between the arc extinguishing metallic plates 13 even though the arc extinguishing metallic plates 13 become swollen by an inner gas which is caused the arc. Accordingly, there is no short-circuiting phenomenon in the arc distinguishing metallic plates 13.

In the embodiment shown in FIG. 35, the arc horn 6B is joined to the end portion of the movable contactor 6A. However, the arc horn 6B may not be provided at the end portion of the movable contactor 6. Further, the arc horn 6B may be formed integrally with the movable contactor 6A.

In the case of the device described with reference to FIG. 35, the arc extinguishing metallic plates 13 have the same length. However, as shown in FIG. 37, for instance, the shape of the end portion of the arc extinguishing metallic plates 13 may be in a forked form as illustrated in FIG. 34.

The fixed contactor 8 with the arc runner 14 as used in the previously mentioned embodiments may be used instead of the fixed contactor 8. Thus, by providing the arc runner 14, the urging of the arc 12 can be obtained at a further high speed. Accordingly, both current limiting ability and current breaking ability can be further increased.

In the case of the device described with reference to FIG. 37, only the arc extinguishing metallic plate **13*e* closest to the fixed contactor 8 is extended to the upper part of the fixed contact. However, it goes without saying that the arc extinguishing metallic plate near the commutation plate 15** may have the same length and shape.

As described above, in accordance with the embodiment as in FIGS. 35–37, the insulating plates 30 are arranged between each of the arc extinguishing metallic plates. Accordingly, there is no direct contact between the arc extinguishing metallic plates even though staying of the arc causes the arc extinguishing metallic plates 13 to be swollen. Accordingly, both of the current breaking ability and current limiting ability can be improved.

A switch as shown in FIGS. 38–41 is so constructed that an insulating material is disposed at the opposite side of the arc extinguishing metallic plates 15 with respect to a portion to which an arc enters. With the construction, arc gas is controlled to be discharged outside; current breaking ability is improved by avoiding the staying of the arc; an arc space is reduced, and arc touch is prevented.

Figure 38:
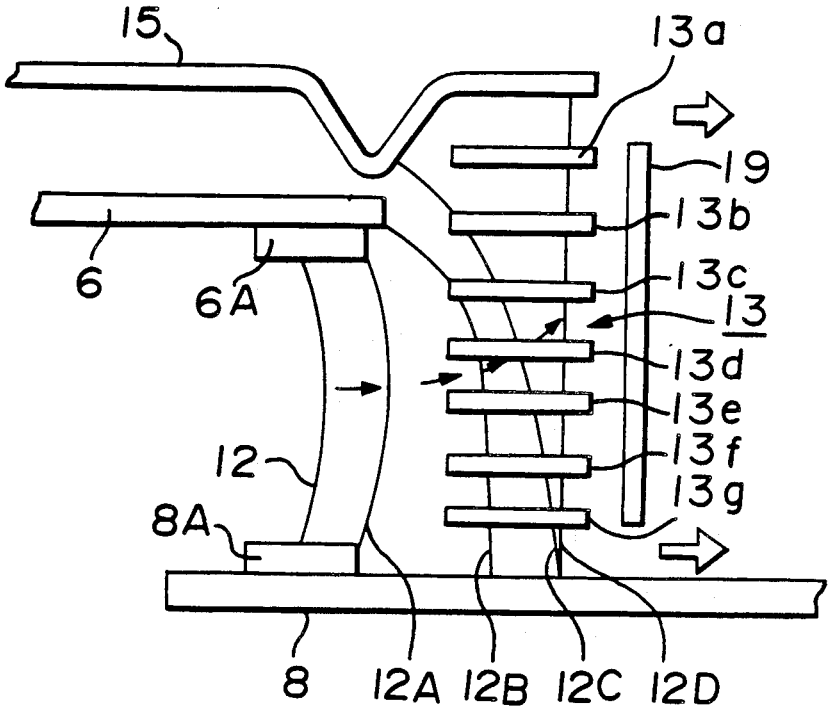
FIG. 38 is a cross-sectional view of an important part of another embodiment of the present invention to illustrate arc extinguishing operation.
Figure 39:
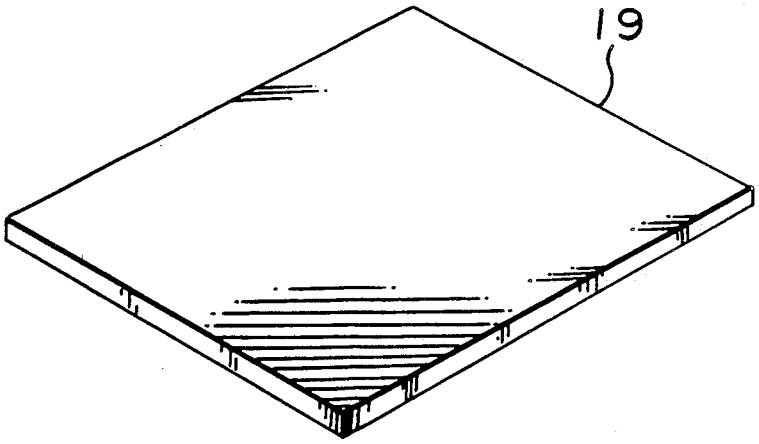
FIG. 39 is a perspective view showing an insulating plate used for the embodiment.
Figure 40:
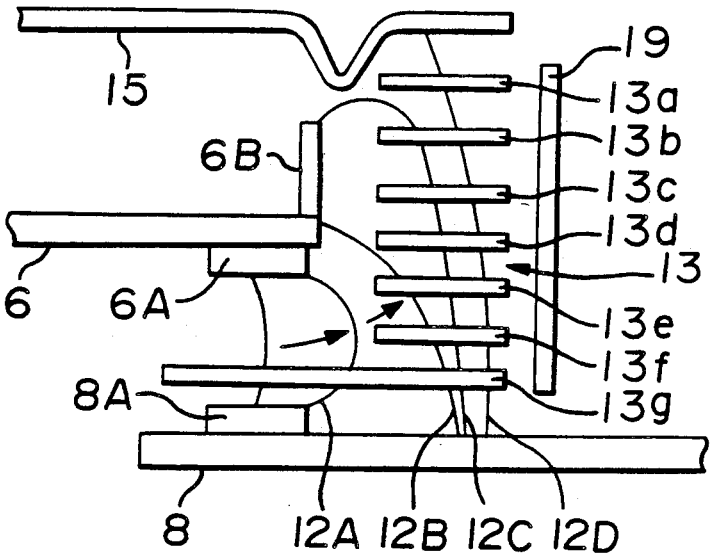
FIG. 40 is a cross-sectional view showing another embodiment of the present invention.

Namely, in FIG. 38, an insulating plate 19 as illustrated in FIG. 39 is provided so as to be along the arc extinguishing metallic plates 13 at a position opposite the arc entrance part with respect to the arc extinguishing metallic plates 13.

In FIG. 38, when the movable contact 6A is separated from the fixed contact 8A, an arc 12 is produced as illustrated in the figure and the arc takes such progress that it takes the forms of 12A, 12B and 12C successively; finally, the arc takes the form of an arc 12D, and is cooled by the arc extinguishing metallic plates 13 to be extinguished.

In this case, since the urging of the arc after the generation of the arc and the shift of the arc from the state of the arc 12C to the state of the arc 12D are satisfactorily take place, time required for interruption is shortened and the current limiting ability is also increased as described before. Accordingly, arc energy is decreased at the interruption time and interruption of a large electric current is possible.

Thus, by disposing the insulating plate 19 so as to be along the end portion of the arc extinguishing metallic plates 13, the arc gas is prevented from being directly discharged. Accordingly, a broad arc space as required in the conventional device is not necessary, and the staying of the arc at the end portions of the arc extinguishing metallic plates 13 can be avoided.

In the above-mentioned embodiment, the arc horn 6B is not joined to the end poriton of the movable contactor 6A. However, the arc horn 6B may be provided at the end portion of the movable contactor 6, or the arc horn 6B is formed integrally with the movable contactor 6A.

In the case of the device described with reference to FIG. 38, the arc extinguishing metallic plates 13 have the same length. However, the arc extinguishing metallic plate **13*g* closest to the fixed contactor 8 among the arc extinguishing metallic plates may have a length extending to a position corresponding to the fixed contactor 8A**, for instance.

In this case, the end portion of the arc extinguishing metallic plate **13*g*** may have two-forked legs at the end portion as described in the previous embodiments.

Figure 41:
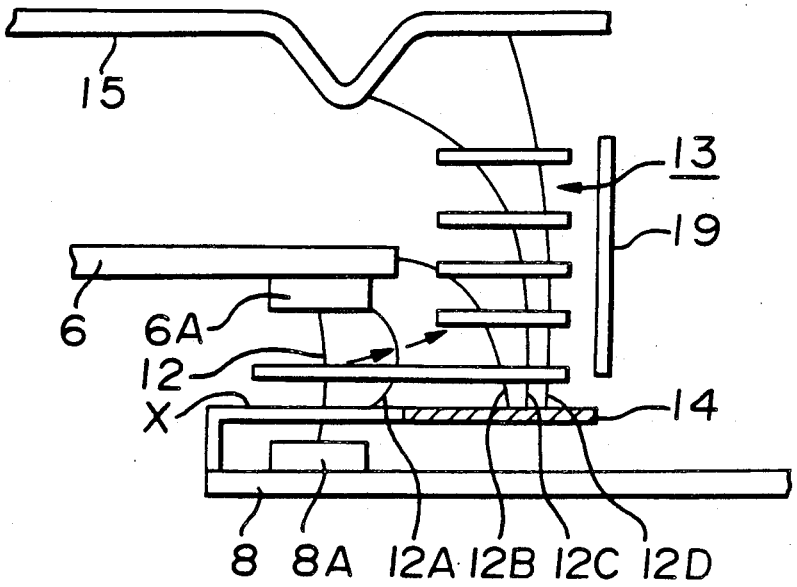
FIG. 41 is a cross-sectional view showing another embodiment of the present invention.

Further, a fixed contactor 8 with an arc runner 14 in which a window 14A to have the movable contact 6A passed may be used to give the construction as illustrated in FIG. 41, instead of the fixed contactor 8 as in FIG. 38.

As described above, in accordance with the embodiment shown in FIGS. 38–41, the discharging of the arc gas to each part is controlled by the insulating plate 19 as an insulating material; miniaturization of the arc space can be expected as well as the control of stagnant the arc at the end part of the arc extinguishing metallic plates 13, and current breaking ability can be improved.

Figure 42:
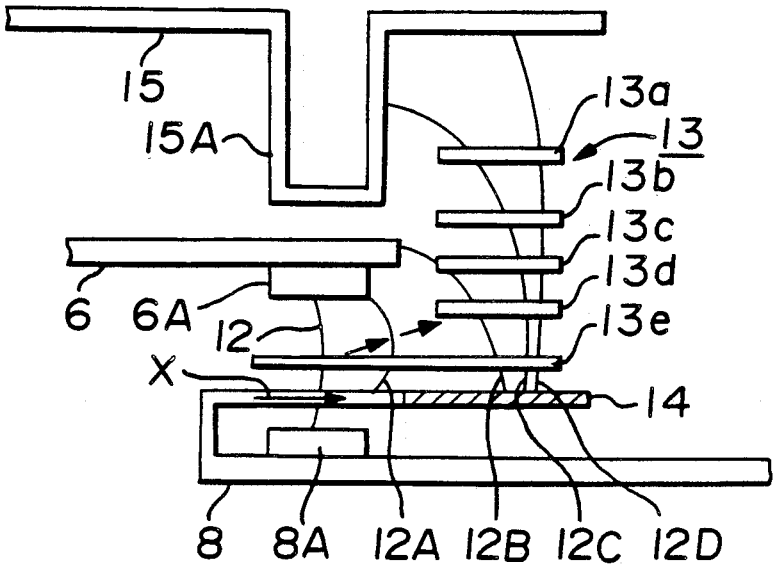
FIG. 42 is a cross-sectional view of an important part of another embodiment of the present invention to illustrate arc extinguishing operation.
Figure 43:
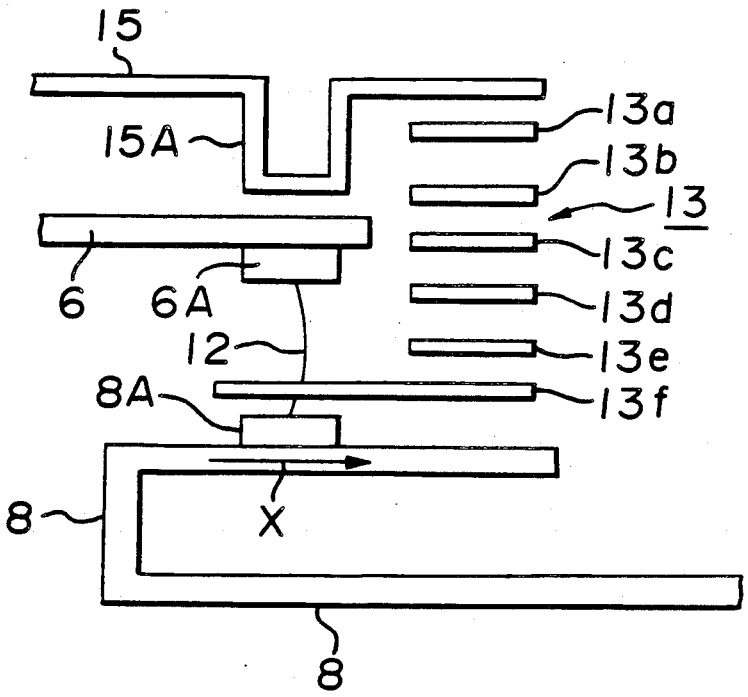
FIG. 43 is a cross-sectional view of another embodiment of the present invention.

In an embodiment of the switch shown in FIGS. 42–43, the portion corresponding to the movable contact 6A of a commutation plate 15 is bent on the side of the movable contact 6A to form a U-shaped leg portion 15A. With such construction, the rising speed of an initial arcing voltage is increased to improve current limiting ability and current breaking ability.

As described above, in accordance with the embodiment as in FIGS. 42, 43, the leg portion 15A is formed at the commutation plate 15 whereby both the current breaking ability and current limiting ability can be improved.

In an embodiment of the switch as shown in FIGS. 44–47, the portion corresponding to the movable contact 6A of a commutation plate 15 is bent on the side of the movable contact 6A to form a leg portion in which the free end of the commutation plate is bent so as to be inclined on the side of the arc extinguishing metallic plates to thereby form the leg portion. With such construction, the rising speed of an initial arcing voltage is increased to improve current limiting ability and current breaking ability.

Figure 44:
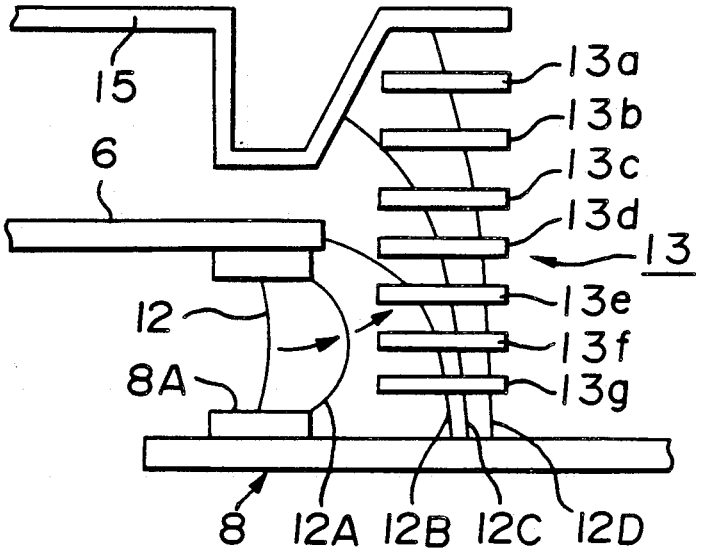
FIG. 44 is a cross-sectional view of an important part of another embodiment of the present invention to illustrate arc extinguishing operation.

Namely, the switch as shown in FIG. 44 is featurized by the fact that a part of the commutation plate is bent on the side of the movable contact 6A and the bent portion is inclined on the side of the free end.

In FIG. 44, when the movable contact 6A is separated from the fixed contact 8A, an arc 12 is produced as shown in the figure.

Figure 45:
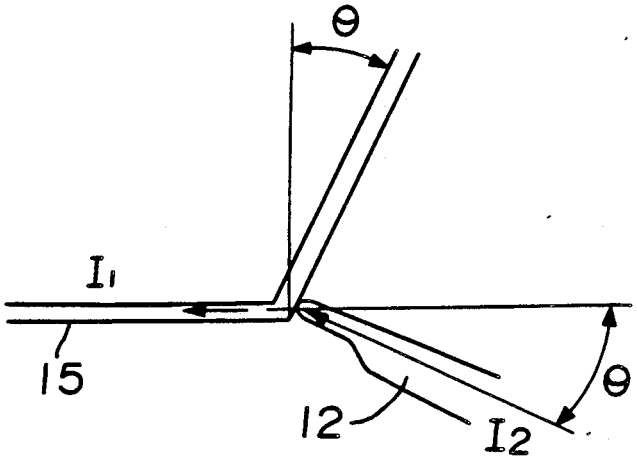
FIG. 45 is an enlarged front view of a part of the commutation plate to illustrate the progress of an arc.

The arc 12 take a progress that it is changed to an arc 12A in a short time; the arc is attracted to the arc extinguishing metallic plates to take the form of an arc 12B and an arc 12C successively; and finally takes the form of an arc 12D, and then it is cooled by the arc extinguishing metallic plates 13 to be extinguished. As described above, since the leg portion is formed in a part of the commutation plate 15, the arc 12 produced at the substantially central portion of the movable contact 6A is moved to the movable contactor 6 via the circumference portion of the movable contact 6A. In this case, the leg portion of the commutation plate is inclined as described above, and the shift of the leg of the arc can be obtained without difficulty, with the result that time required for interruption can be shortened. The function of the commutation plate 15 will be described with reference to FIG. 45. FIG. 45 shows a part of the commutation plate. The horizontal part constitures the leg portion of the commutation plate 15. This embodiment is featurized by using the commutation plate 15 with the leg portion inclined at an angle of $90° C. > \Phi > 0° C.$ with respect to the horizontal plane.

In FIG. 45, when the arc 12 is moved on the lower end of the leg portion of the commutation plate 15, an electric current $I_1$ flowing in the commutation plate 15 intersects an electric current $I_2$ forming the arc so that an electromagnetic force caused by $I_1$ acts on the arc 12 to drive it upwardly. Then, the arc 12 is rapidy urged upwardly with the consequence of increasing the rising speed of an arc voltage to thereby improve the current-limiting ability and current breaking ability remarkably.

Such effect can be obtained by determining the value of $\Phi$ to be, for instance, about 30° C. However, such value should not be considered to be fixed, normally, it is selected from a range of about 5°–60° C. depending on requirements.

Figure 25:
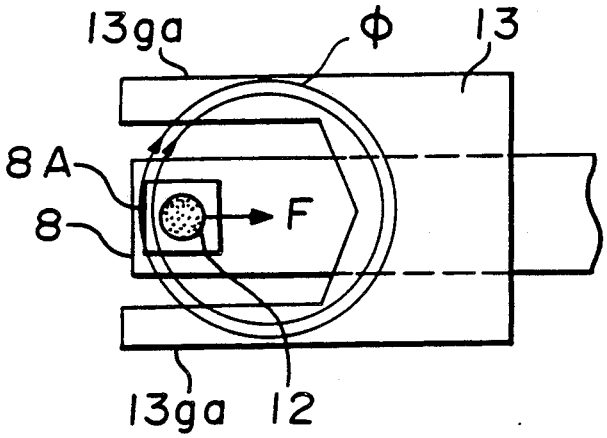
FIG. 25 is a plan view showing a relation of an arc extinguishing metallic plate to a fixed contactor.

In the switch having such effect, an arc extinguishing metallic plate with two legs **13*ga* as shown in FIG. 25 may be used as the arc extinguishing metallic plate 13*g* closest to the fixed contact among the arc extinguishing metallic plates 13**.

Figure 46:
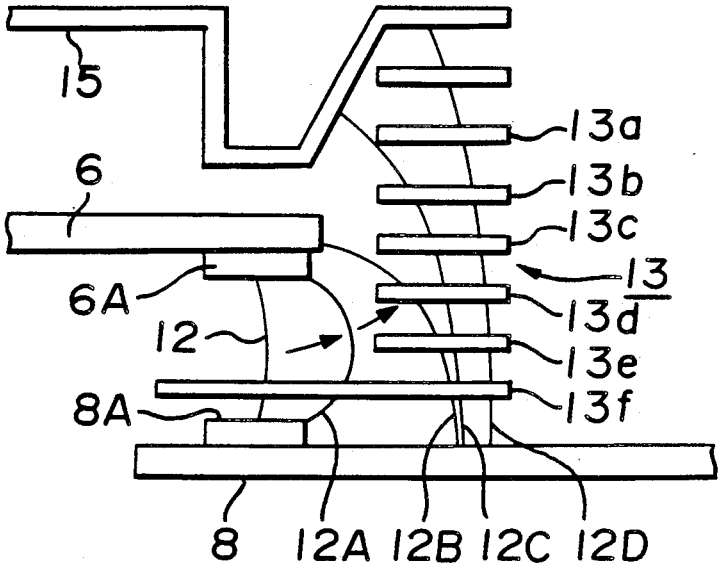
FIGS. 46 and 47 are respectively cross-sectional views showing other embodiments of the present invention.

FIG. 46 shows a switch in which the above-mentioned arc extinguishing metallic plates 13 are assembled.

Figure 47:
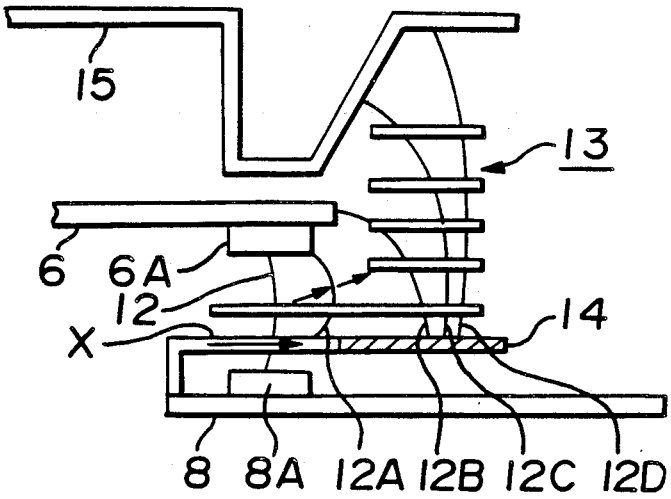

FIG. 47 is a sectional view of another embodiment in which an arc runner 14 is provided on the fixed contactor 8.

FIGS. 48–51 show still another embodiment of the present invention which is constructed in such a manner that a bent portion having a substantially U-shape of a cummutation plate is disposed between the movable contactor and arc extinguishing metallic plates so that the top portion of the bent portion is determined to be on the substantially same level as a position where open-circuit of the movable contactor is completed; some of the arc extinguishing metallic plates located between the fixed contactor and the movable contactor at the position of the completion of open-circuit are extended to the side of a space in which the movable contactor is movable, and the arc extinguishing metallic plates are all positioned near the area where an arc is produced at the initial stage, whereby the arc produced by the separation of the movable contact from the fixed contact is urged and accelerated by the arc extinguishing metallic plates; moving speed of the arc to the commutation plate, i.e. the rising speed of an arcing voltage is increased; the arc transferred onto the commutation plate is smoothly moved to the end of the commutation plate without staying at the central poriton of the surface of the end portion, and the moving speed of the arc on the commutation plate is increased.

FIG. 48 is a cross-sectional view of an important part of the embodiment to illustrate arc extinguishing function; FIG. 49 is a diagram of an element shown in FIG. 48; FIG. **50*a* is a diagram showing the shape of an arc extinguishing metallic plate; and FIG. 50*b*** is a diagram showing the shape of another arc extinguishing metallic plate.

In FIG. 48, a numeral 15 designates a commutation plate whose base portion is disposed above the movable contactor 6. An end portion **15*a* in a U-shaped portion extending toward the fixed contactor 8 is formed at the side of the end of the commutation plate 15. The bent portion 15*a* of the commutation plate 15 is disposed between the movable contactor 6 and the arc extinguishing metallic plates 13, and further, it is so determined that the top end of the bent portion 15*a* is substantially flush with a position where the open-circuit of the movable contactor 6 is completed. Of the arc extinguishing metallic plates 13, two arc extinguishing metallic plates 13*e*, 13*f* placed between the fixed contactor 8 and the movable contactor 6 at the position of the open-circuit are respectively provided with a pair of legs 13*fe*, 13*fe* 13*ff*, 13*ff* which are extended from the both end sides to the side of the space where the movable contactor 6 is movable. Further, of the arc extinguishing metallic plates 13, four arc extinguishing metallic plates 13*a*–13*d* placed between the commutation plate 15 and the movable contactor 6 at the position of completion of the open-circuit are respectively provided with a pair of short legs 13*fa*, 13*fa*–13*fd*, 13*fd* which are respectively close to the side of the bent portion 15*a* of the commutation plate 15 by extending from the short side of the edge, as shown in FIG. 50*a*. FIG. 50*b* shows a modified embodiment of the arc extinguishing metallic plates 13a–13d as shown in FIG. 50a which are respectively provided with a small-sized projection 13h** at the center of its end.

In the switch constructed as above-mentioned, when the movable contact 6A is separated from the fixed contact 8A, an arc 12 is produced between the both contacts 6A, 8A as shown in FIG. 48. A magnetic flux $\phi$ is formed around the arc 12, and the arc 12 is elongated by receiving a force as indicated by the arrow mark F directing to the arc extinguishing metallic plates 13e, 13f of magnetic substance, whereby it is moved toward the arc extinguishing metallic plates 13. In this case, since leg portions 13fe, 13ff extending to the side of the movable contactor 6 are formed in the arc extinguishing metallic plates 13e, 13f, the arc extinguishing metallic plates 13e, 13f are close to the position where the arc is produced at the initial stage, namely, the magnetic resistance becomes small while the magnetic flux $\phi$ becomes strong so that the force of F is strengthened. Then, the arc 10 is accelerated in the direction of F, and the moving speed of the arc 12 to the commutation plate 15, i.e. the rising speed of the initial arcing volatage is increased. Then, the upper leg of the arc 12 is transferred from the movable contact 6A to the center of the end portion of the movable contactor 6, and the lower leg is transferred to the center of the end portion of the fixed contactor 8 to thereby become an arc 12A. The upper leg of the arc 12A transferred to the center of the end portion of the movable contactor 6 is smoothly transferred to the center of the top portion of the bent portion 15a of the commutation plate 15 which is the closest to the center of the end portion of the movable contactor 6 since the end of the bent portion 15a of the commutation plate 15 is provided at the position near the end portion of the movable contactor 6 and substantially flush with it. The lower leg is moved on the surface of the fixed contactor 8 to become an arc 12B. The upper leg of the arc 12B transferred to the commutation plate 15 is moved upwardly on the surface of the bent portion 15a by receiving a force directing toward the arc extinguishing metallic plates 13 by the aid of a magnetic flux generated around the arc to thereby become an arc 12C. The arc 12C reaches the fixed contactor 8 via parts 13c–13f of the arc extinguishing metallic plates. The leg of the arc 12C is moved outwardly from the bent portion 15a of the commutation plate 15 to the flat plate portion 15 (on the right hand in the figure) and the arc traverses the whole of the arc extinguishing metallic plates 13a–13f to thereby become an arc 12D communicating with the fixed contactor 8 to be extinguished.

Figure 51:
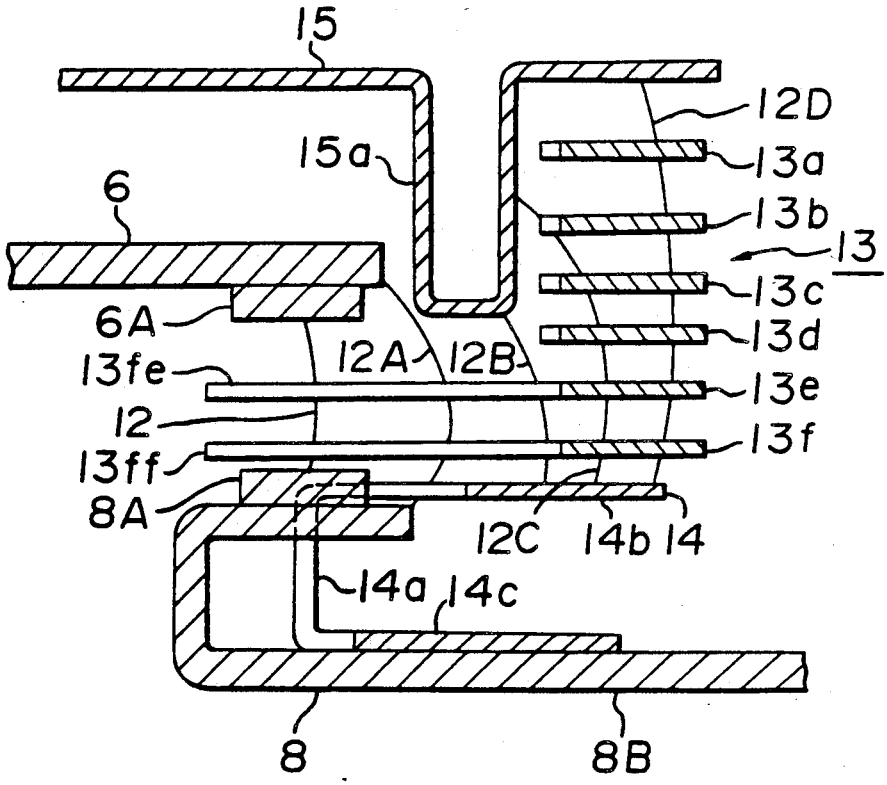
FIG. 51 is a cross-sectional view of an important part of another embodiment of the present invention to illustrate arc extinguishing operation.

FIG. 51 is a cross-sectional view of an important part of another embodiment of the present invention to illustrate arc extinguishing function.

In the embodiment, a pair of leg portions 14a formed by bending an arc runner 14 into a shape of are positioned at the side of the fixed contact 8A in an end of the fixed contactor 8. The arc runner 14 is so provided that the upper end portion 14a of the arc runner 14 is in parallel to the arc extinguishing metallic plates 13, and the lower end portion 14c of the arc runner 16 is in parallel to the base portion of the fixed contactor 8 to provide the same arc extinguishing function as the embodiment described with reference to FIG. 48.

In the embodiments as in FIGS. 48–51, the moving speed of the arc on the commutation plate is increased, current limiting ability and current breaking ability are improved to shorten an interruption time. Further, the wearing of the contacts, damage in the contactors, the commutation plate and metallic plates can be small with the result of elongation of the life time. In addition, an arcing chamber can be minimized by the structure in which the arc runs at the center of the commutation plate.

Figure 52:
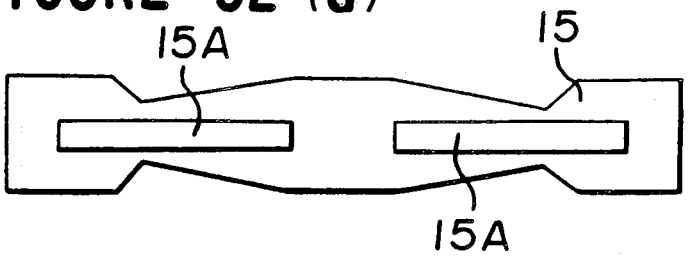
FIGS. 52*a* and 52*b* show a bottom view and a side view of another embodiment of the commutation plate of the present invention respectively.
Figure 52:
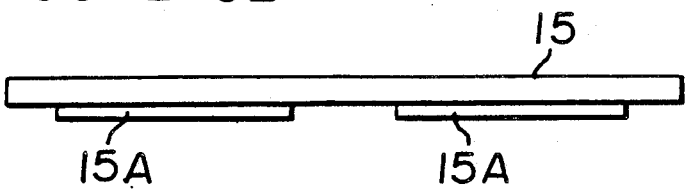
Figure 53:
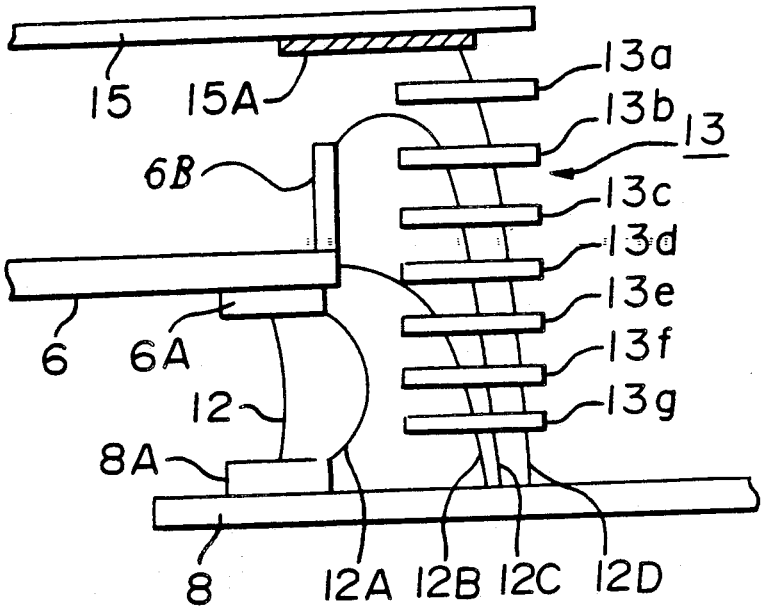
FIG. 53 is a cross-sectional view of an important part of an embodiment according to the present invention to illustrate arc extinguishing operation in the case that the commutation plate in FIG. 52 is used.
Figure 54:
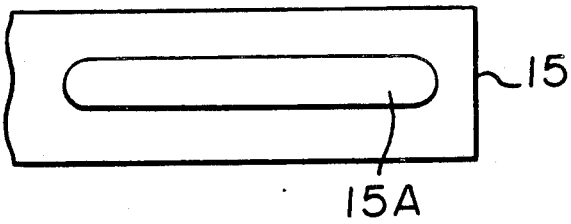
FIGS. 54*a* and 54*b* are respectively bottom views showing other embodiments of the commutation plate respectively.
Figure 54:
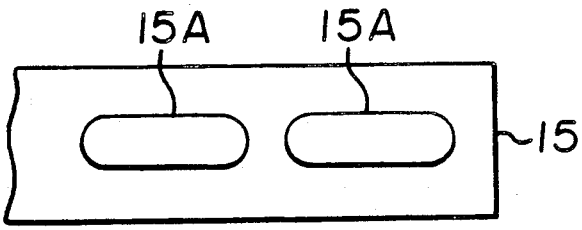

An embodiment as shown in FIGS. 52–54 is constructed under the consideration that during the commutation of the arc on the commutation plate 15 which is horizontally formed, the arc runs along the edges of the commutation plate without running in its central area, with the result that the arc causes the thermal deterioration of the inner wall of the arcing chamber to thereby reduce the inching life. In view of the above-mentioned, a projection is formed in the longitudinal direction of the central part of the commutation plate 15. This structure not only restricts the area for moving the arc, but also increase the moving speed of the arc, and at the same time current breaking ability and the inching life are improved.

FIGS. 52a and 52b respectively show the bottom view and the side view of the above-mentioned embodiment of the present invention. As understandable from the figures, the width of the commutation plate 15 is partly narrowed in the longitudinal direction of the plate 15, and projections 15A are formed continuously or intermittently in the longitudinal direction on the center line.

A structure for arc extinction in which the commutation plate 15 as shown in FIG. 52 is used will be described.

Namely, when the movable contact 6A is separated from the fixed contact 8A, an arc 12 is produced as shown in FIG. 53.

The arc 12 takes the progress that the arc is attracted to the arc extinguishing metallic plates 13 of magnetic substance to assume an arc 12A in a short time while the upper and lower legs separate from the contacts at the first stage; then, the arc changes its state to be an arc 12B and an arc 12C successively; it takes finally the form of an arc 12D, and is cooled by the arc extinguishing metallic plates 13 to be extinguished.

The upper leg of the arc 12 produced around the substantially central part of the movable contact 6A moves along the outer edge of the movable contactor 6 to reach the commutation plate 15 through the arc horn 6B. In this case, the arc 12 having reached the commutation plate 15 from the peripheral part of the movable contact 6A via the movable contactor 6 immediately starts its movement along the projections 15A since the projections 15A are formed in the longitudinal direction at a part in the commutation plate 15. Accordingly, time required for interruption can be remarkably shortened.

FIGS. 54a and 54b show the lower surface of or around the end portion of the commutation plate 15 in which the projections 15A are continuously or intermitently formed in the longitudinal direction of the commutation plate 15.

Figure 55:
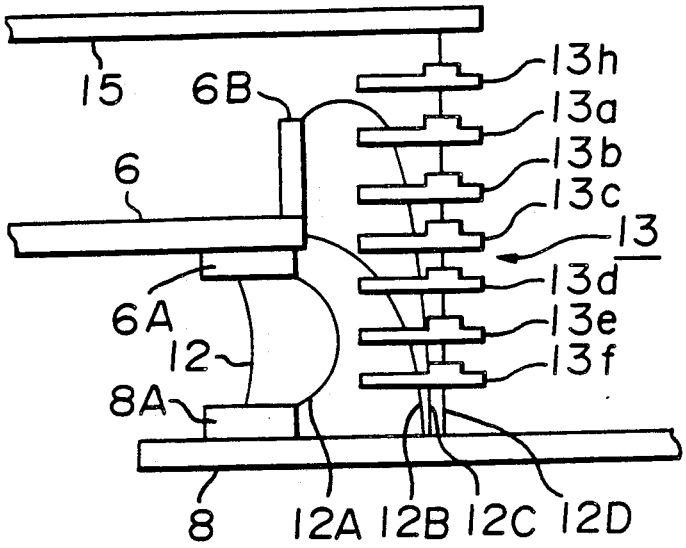
FIG. 55 is a cross-sectional view of an important part of another embodiment of the present invention to illustrate arc extinguishing operation.
Figure 56:
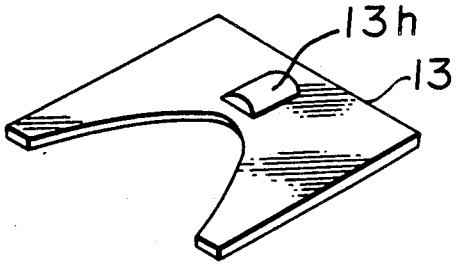
FIG. 56 is a perspective view showing the arc extinguishing metallic plate.
Figure 57:
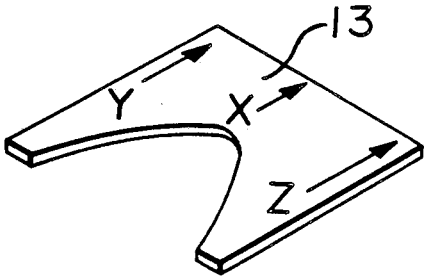
FIG. 57 is a perspective view showing the arc extinguishing metallic plate before improvement.

FIGS. 55–57 show another embodiment of the present invention.

This embodiment is proposed from the viewpoint that in the case that the arc extinguishing metallic plates 13 of magnetic substance are made flat, it is difficult to determine which course the arc passes among positions x, y, z in each of the arc extinguishing metallic plates 13 as illustrated in FIG. 57, and if the arc often passes the position y or z without passing through the position x, for instance, an insulating material constituting side walls of the arc extinguishing metallic plates 13 often suffers a high temperature radiation to thereby damage the insulating material. This embodiment is characterized by providing a projection at the central portion of each of the arc extinguishing metallic plates.

In FIG. 55 showing an embodiment of the present invention, the arc extinguishing metallic plates 13 used for the embodiment respectively have a projection 13*h* as illustrated in FIG. 56.

In FIG. 55, when the movable contact 6A is separated from the fixed contactor 8A, an arc 12 is produced as shown in the figure.

The arc 12 is attracted to the arc extinguishing metallic plates 13 of a magnetic substance to change its form to an arc 12A. The upper leg of the arc 12A passes around the end portion of the movable contactor 6, and the lower leg is separated from the fixed contact 8A, passing a part of the art extinguishing metallic plates 13 to reach the fixed contactor to thereby become an arc 12B.

The arc 12B is finally changed to an arc 12D via the state of an arc 12C which is formed by the movement of the upper leg from the lower part of the arc horn 6B to the upper part of it, the arc 12C jumping from the top of the arc horn 6B. In this case, the arc 12D does not become unstable because the projection 13*h* is formed on the surface of the arc extinguishing metallic plates 13 and the arc 12D is cooled at the predetermined position to be extinguished.

As described above, in accordance with this embodiment, the arc does not become unstable and is extinguished in a predetermined cource because the projection is formed at a predetermined position of the arc extinguishing metallic plates. Accordingly, there is no damage to an insulating material which forms the outer wall, and both current breaking ability and current limiting ability can be improved.

Figure 58:
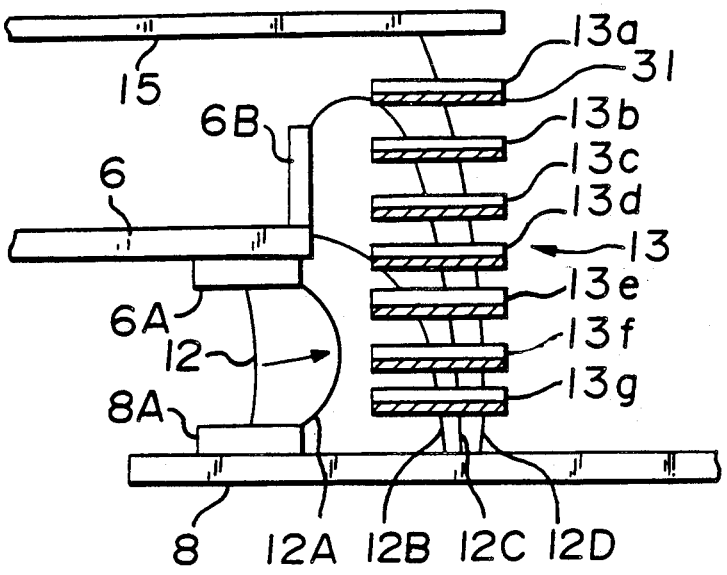
FIG. 58 is a cross-sectional view of an important part of another embodiment of the present invention to illustrate arc extinguishing operation.
Figure 59:
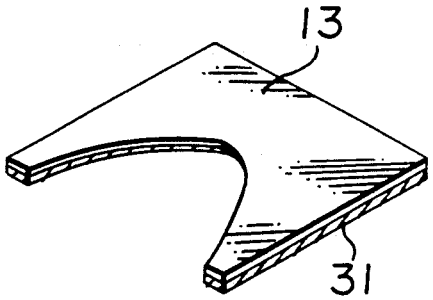
FIG. 59 is a perspective view showing an arc extinguishing metallic plate having the both surfaces to which insulating plates are attached.
Figure 60:
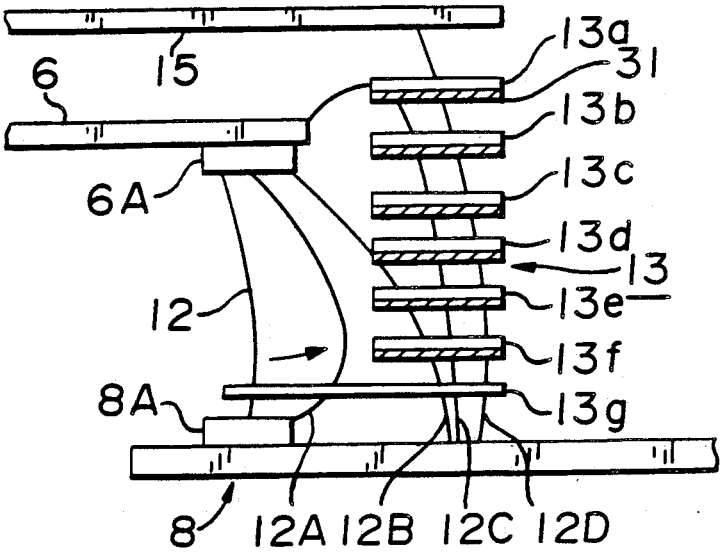
FIG. 60 is a cross-sectional view of an important part of another embodiment of the present invention.

An embodiment as shown in FIGS. 58–60 will be described. When the movable contact 6A is separated from the fixed contact 8A, an arc 12 is produced. When the arc 12 is attracted to the arc extinguishing metallic plates 13 for extinction, stagnancy in the arc 12 is sometimes caused at certain portions in the arc extinguishing metallic plates 13 during the period of extinction. Then, gas around the arc extinguishing metallic plates 13 is expanded by heat, with the result that the arc extinguishing metallic plates 13 become swollen. In the worst case, there causes mutual contact of the arc extinguishing metallic plates 13 to cut the arc 12 and to reduce cooling effect. This may cause incapability of interruption.

This embodiment is to eliminate such problem and to obtain a switch capable of maintaining for a long time performance inherently expected to a switch. This embodiment is characterized by coating an insulating material on at least one surface of each of the arc extinguishing metallic plates.

The embodiment will be concretely described. The device as shown in FIG. 58 has a feature that one surface of each arc extinguishing metallic plate 13 is covered by an insulating plate 31 as shown in FIG. 59.

As material for the insulating plate 31, it is sufficient to cause evaporation when it is subjected to a high temperature. Generally an organic material is used.

In FIG. 58, when the movable contact 6A is separated from the fixed contact 8A, an arc 12 is produced as shown in the figure.

The arc 12 is attracted to the arc extinguishing metallic plates 13 of a magnetic substance to change its form into an arc 12A. The upper leg of the arc 12A passes around the end portion of the movable contactor 6 and the lower leg is separated from the fixed contact 8A while it passes through a part of the arc extinguishing metallic plates 13, whereby an arc 12B extending to the fixed contactor is formed.

The arc 12B is finally becomes an arc 12D by the movement of the upper leg on the commutation plate 15. In this case, the presence of the insulating plate 19 on one surface of each of the arc extinguishing metallic plates 13 prevents the mutual contact of the arc extinguishing metallic plates 13 even when there causes the staying of the arc 12 around the arc extinguishing metallic plates 13 due to any cause in the period from generation of the arc to its extinction. The arc can be cut in a stable manner; a stable cooling effect can be obtained, and current breaking ability can be improved.

The present invention is not only effective to the above-mentioned embodiment, but also effective to modified embodiments. For instance, the lowermost arc extinguishing metallic plate 13*g* among the arc extinguishing metallic plates 13 may have a forked shape at its end as illustrated in the arc extinguishing metallic plate 13*e* as in FIG. 49. FIG. 60 shows an example using the arc extinguishing metallic plates 13 having the shape. The progress of the arc 12 in this case is substantially the same as that as described with reference to FIG. 58.

As described above, in accordance with the embodiment shown in FIGS. 58–60, there is no risk of direct contact of the arc extinguishing metallic plates even though the stagnant arc causes the arc extinguishing metallic plates swollen because the insulating material is covered on at least one surface of each of the arc extinguishing metallic plates. Accordingly, both current breaking ability and current limiting ability can be improved.

Figure 61:
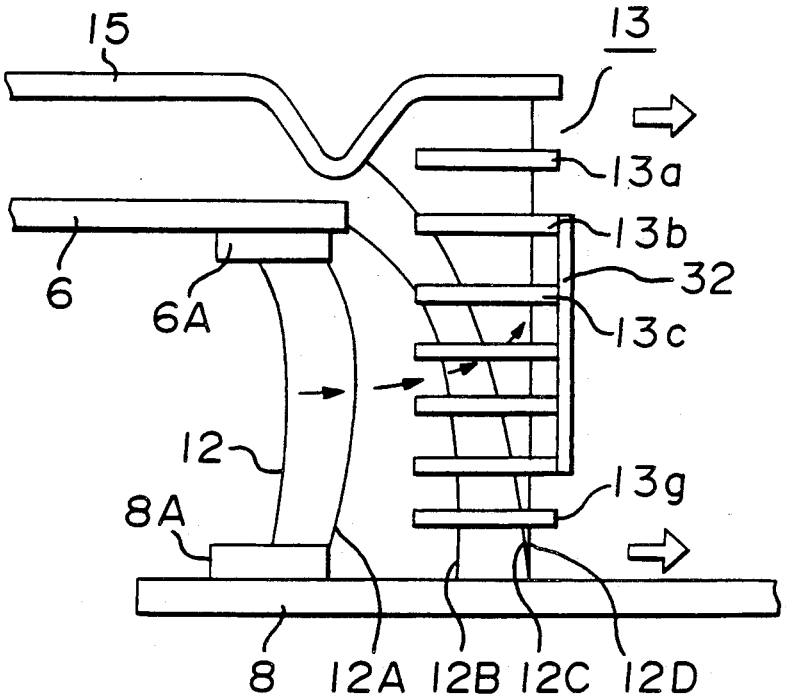
FIG. 61 is a cross-sectional view of an important part of another embodiment of the present invention to illustrate arc extinguishing operation.
Figure 62:
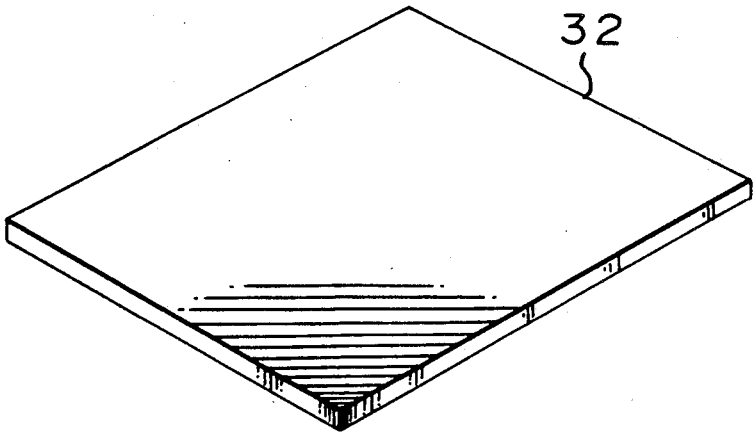
FIG. 62 is a perspective view of the insulating plate used for the above-mentioned embodiment.
Figure 63:
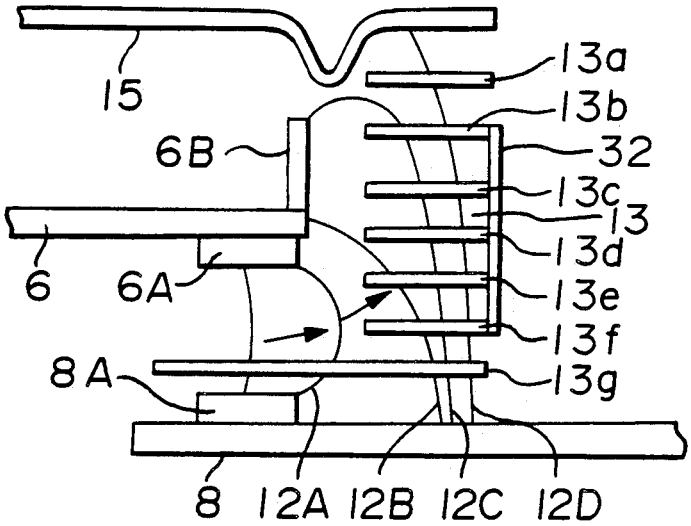
FIG. 63 is a cross-sectional view of another embodiment of the present invention.

An embodiment as shown in FIGS. 61–63 will be described. In the previously mentioned embodiments, the switch has such construction that arced gas produced at an interruption time is directly discharged outside. Accordingly, there is a point to be improved. That is, an arc space formed between a switch and a casing, a switch board containing the switch, or the door of the switch board has to be large. Further, from the viewpoint of its function, there is disadvantages that an arc 12 generated at an interruption time is strongly attracted to the arc extinguishing metallic plates of the magnetic substance having flat surfaces, whereby the arc often reaches the end portion of the arc extinguishing metallic plates 13 to cause the staying of an arc 12D at its end portion to thereby invite inability of interruption.

In view of such disadvantage, the present embodiment is featurized by covering the end portion of each of the arc extinguishing metallic plates with an insulating material to control discharging of the arced gas to the outside.

In accordance with the embodiment shown in FIGS. 61–63, the discharging of the arced gas is controlled and the position of the arc generated is given at a predetermined area to minimize the staying of the arc by slightly modifying the outer portion of the arc extinguishing metallic plates, whereby a switch capable of improving current breaking ability can be provided.

An embodiment of the present invention will be described with reference to the drawing.

The switch shown in FIG. 61 has a characteristic feature that an insulating plate 32 as shown in FIG. 62 is used which is in contact with the end portion of the arc extinguishing metallic plates 13.

In FIG. 61, when the movable contact 6A is separated from the fixed contact 8A, an arc 12 is produced as shown in the figure.

The arc 12 is attracted to the arc extinguishing metallic plates 13 of a magnetic substance to change its form into an arc 12A. The upper leg of the arc 12A passes around the end portion of the movable contactor 6, and the lower leg is separated from the fixed contact 8A while it passes through a part of the arc extinguishing metallic plates 13 to thereby become an arc 12B reaching the fixed contactor.

The arc 12B finally changes to an arc 12D by the movement of the upper leg to a downwardly bent portion of the commutation plate 15. In this case, the arced gas produced in the period from generation of the arc to its extinction can not be directly discharged outside owing to the insulating plate 32 provided at the end portion of the arc extinguishing metallic plates 13, but is discharged from another discharging route gradually.

Thus, by controlling the movement of the arced gas, the arc 12D is prevented from shifting to the end portion of the arc extinguishing metallic plates 13, and accordingly, the staying of the arc 12 at the end portion of the arc extinguishing metallic plates 13 is not caused and the arc is cooled at a predetermined position to be extinguished.

The present invention is not only applicable to the above-mentioned embodiment, but also it is applicable to a device, as a modified embodiment, having the construction as shown in FIG. 63.

Namely, the feature of the device as in FIG. 63 is that the lowermost arc extinguishing metallic plate 13g among the arc extinguishing metallic plates 13 has a forked end portion.

The embodiment of FIG. 63 provides the same function and effect as that of FIG. 61.

Figure 64:
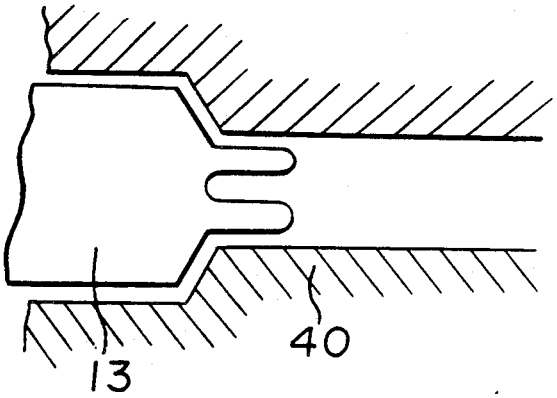
FIG. 64 is a plan view of another embodiment of the present invention to show an arc extinguishing metallic plate and the wall surface of a casing to protect the plate.
Figure 65:
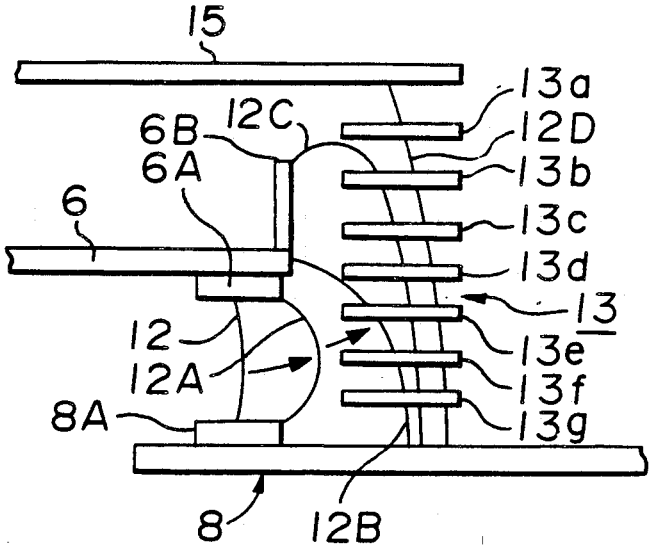
FIG. 65 is a cross-sectional view of an important part of the above-mentioned embodiment to illustrate arc extinguishing operation.

An embodiment as shown in FIGS. 64–65 will be described.

The embodiment as shown in FIGS. 64–65 is so constructed that the width of the end portion of each of the arc extinguishing metallic plates 13 is made thin at the side of the contacts, and a casing wall around the arc extinguishing metallic plates 13 is also narrowed, whereby an arc is strongly urged for extinction by utilizing pressure difference (air gap function) caused by the generation of the arc near the contacts in association with the above-mentioned two arc driving sources.

The embodiment of the present invention will be described with reference to FIGS. 64 and 65.

FIG. 64 shows a part of the arc extinguishing metallic plates 13 used in the example in a plane view. As seen from the view, the end portion of the arc extinguishing metallic plate 13 has a thin, narrowed shape.

With such construction, the pressure of gas caused by the arc generated is increased, and the pressure is utilized as a driving source for the arc.

FIG. 65 shows an example of the present invention in which the arc extinguishing metallic plates 13 which are processed to have the shape as shown in FIG. 64 are used.

In FIG. 65, when the movable contact 6A is separated from the fixed contact 8A, an arc 12 is produced in the same manner as the previously mentioned embodiments.

The arc 12 takes the progress that it changes into an arc 12A in a short time by the influence of the magnetic substance; the arc is attracted to the arc extinguishing metallic plates 13 to take the form of an arc 12B and an arc 12C successively; the arc finally changes into an arc 12D; and it is cooled by the arc extinguishing metallic plates 13 to be extinguished.

In the movement of the arc, the gap effect it obtained by making the end portion of the arc extinguishing metallic plates thin and by making the wall of the casing 40 surrounding the plates 13 to be narrowed.

The generation of the arc, the urging of the arc and the shift of the arc from the state of an arc 12C to the state of an arc 12D are satisfactorily carried out, and time required for breaking is shortened and current limiting ability is also increased as described before, whereby arc energy at an interruption time is decreased to allow interruption of a large electric current.

In the above-mentioned embodiment, description has been made as to the case that the arc horn 6B is joined to the end portion of the movable contactor 6. However, the arc horn 6B may be omitted.

In the case of the device described with reference to FIG. 65, the length of the arc extinguishing metallic plates 13 is the same. However, it is possible that for instance, at least one of the arc extinguishing metallic plates 13 has the shape extending to a position near the fixed contactor 8A, and the arc extinguishing metallic plate has its end portion which is forked to provide leg portions.

As described above, in accordance with the embodiment shown in FIGS. 64 and 65, the urging force of the arc can be further improved in comparison with the conventional device by simply changing the shape of the arc extinguishing metallic plates and by narrowing the surface of the casing for protecting the circumference so as to correspond to the shape of the arc extinguishing metallic plates.

This means improvement of the current breaking ability and the current limiting ability of the switch, and the effect of it is remarkably large.

An embodiment as shown in FIGS. 66–69 will be described.

In the above-mentioned embodiments, a plurality of the arc extinguishing metallic plates 13 of the magnetic substance are merely arranged in parallel to each other. Accordingly, the arc may be discharged outside during the length of the arc being short, whereby there may cause a trouble of grounding or external short-circuiting. In the embodiment shown in FIGS. 66–69, the ends of or the areas near the ends of the commutation plate and the arc extinguishing metallic plates are radially broadened. Since the switch of the present invention is provided with the arc extinguishing metallic plates whose end portion is made in a radial form, it is effective to prolong the length of the arc by inclining the arc extinguishing metallic plates and the commutation plate. Accordingly, chance of contacting of the arc with air is increased and a cooling effect is large, whereby an arc voltage is rapidly raised and the arc can be diffused, with the result of increasing current breaking ability.

The above-mentioned embodiment of the present invention will be described with reference to the drawing.

Figure 66:
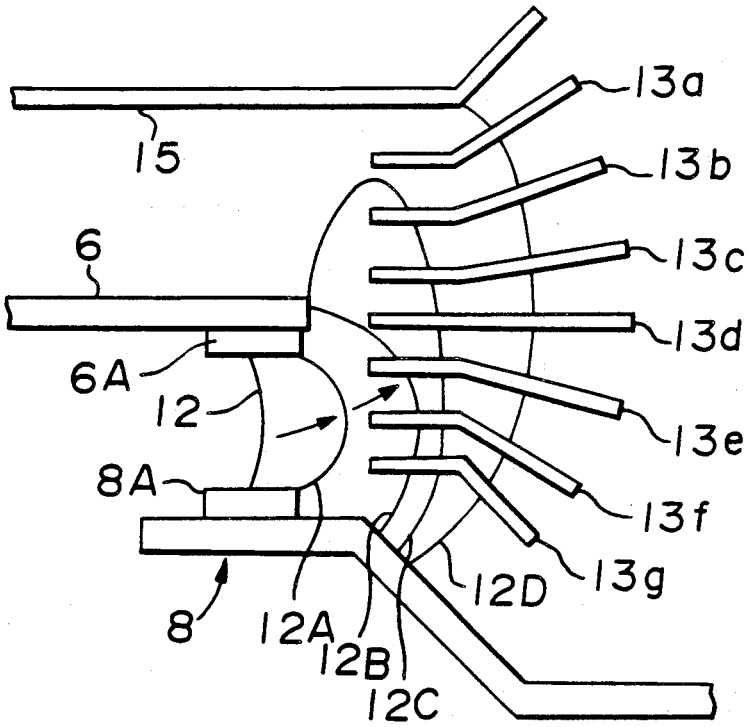
FIG. 66 is a cross-sectional view of an important part of another embodiment of the present invention to illustrate arc extinguishing operation.

The embodiment of the present invention shown in FIG. 66 has a featurized construction that the arc extinguishing metallic plates 13, the commutation plate 15 and the fixed contactor 8 are broadened toward their end portions.

In FIG. 66, when the movable contact 6A is separated from the fixed contact 8A, an arc 12 is produced. The arc 12 is attracted to the arc extinguishing metallic plates 13 of a magnetic substance to become an arc 12A. Then, the arc changes into an arc 12B and an arc 12C successively. When the arc 12 progresses beyond the broadened portions of the arc extinguishing metallic plates 13, the commutation plate 15 and the fixed contactor 8, and becomes, for instance, an arc 12A, chance of contacting of the arc with air suddenly increased which functions to cool the arc 12.

Figure 67:
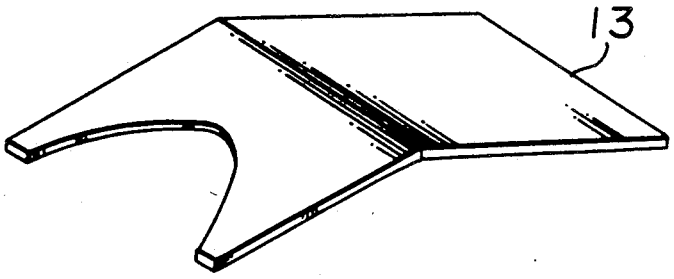
FIG. 67 is a perspective view of the arc extinguishing metallic plate used for the above-mentioned embodiment.

The arc extinguishing metallic plates 13 used for this purpose are formed by bending their part (it is unnecessary to bend the arc extinguishing plate placed at the center) as shown in FIG. 67.

Thus, the arc 12 is completely extinguished without causing grounding or external short-circuiting. In this case, the arc extinguishing metallic plate 13*g* closest to the fixed contact 8A may have a forked portion which provides two legs at the part corresponding to the fixed contact 8A.

Figure 68:
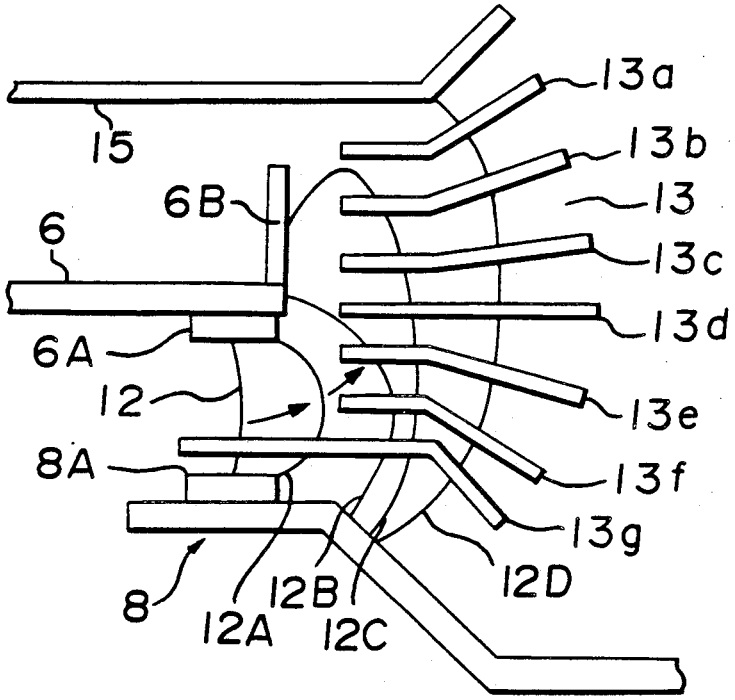
FIGS. 68 and 69 are respectively cross-sectional views of an important part of other embodiments of the present invention.

FIG. 68 shows an example of an arc extinguishing metallic plate 13*g* provided with leg portions.

The arc 12 produced between the contacts takes a progress that it becomes an arc 12A in a short time as shown in FIG. 68; the arc is attracted to the arc extinguishing metallic plates other than 13*g* to thereby take the form of an arc 12B and an arc 12C successively; it finally becomes an arc 12D, and is cooled by the arc extinguishing metallic plates 13 to be extinguished.

Thus, since the urging of the arc just after the generation of the arc and the shift of the arc from the state of the arc 12C to the state of the arc 12D are satisfactorily obtained. Time required for interruption is shortened and the current limiting ability can be increased in the same manner as described before. Accordingly, arc energy at a breaking time is decreased to allow interruption of a large electric current.

Figure 69:
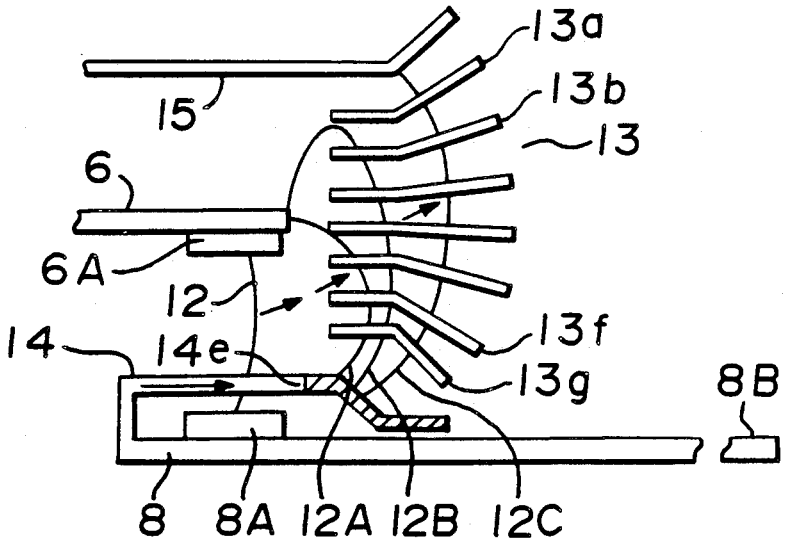

In the embodiment as shown in FIG. 69, an arc runner 14 having an inversed L-shape is electrically joined to the end portion of the fixed contactor 8 at the side of the fixed contact 8A, and the arc runner 14 is so constructed that the movable contactor 6 is passed through a notched portion 14*e* of the arc runner 14 to come into contact with the fixed contact 8A. Thus, by providing the arc runner 14, the urging of the arc 12 can be further accelerated, and both current limiting ability and current breaking ability can be further increased.

As described above, in accordance with the embodiment as shown in FIGS. 66–69, each end portion of the arc extinguishing metallic plates, the fixed contactor and the commutation plate is widened to diffuse the arc. Accordingly, rising of an arc voltage is increased and arc can be elongated to thereby improve the current breaking ability.

Figure 71:
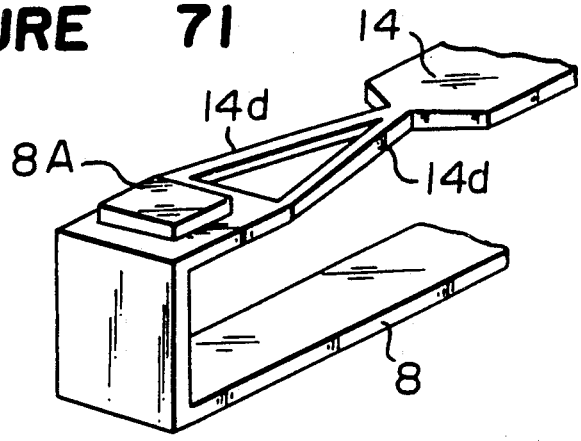
FIGS. 70 and 71 are respectively perspective views a fixed contactor according to other embodiments of the present invention.
Figure 70:
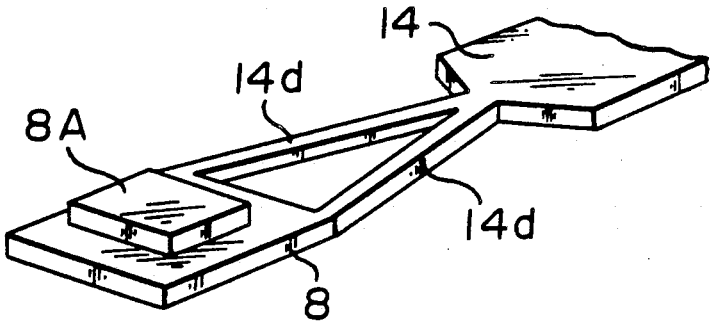

An embodiment as shown in FIGS. 70 and 71 will be described. In the above-mentioned embodiments, the width of the fixed contact 8 is uniformly. Accordingly, it is difficult to carry out a rapid urging of the arc on the fixed contactor. Further, thermal deterioration of the side wall at the side of the fixed contactor is great, and the inching life is short. Thus, there are many problems to be improved.

In this embodiment, the fixed contact is provided on the upper surface of the fixed contactor and an arc runner having a narrow path is formed in the fixed contactor.

The embodiment of FIGS. 70 and 71 is attained as a result of study on the shape of the fixed contactor, and the rapid urging of an arc on the fixed contactor can be obtained by positioning the arc runner having the narrow path at the outer side of the fixed contact of the fixed contactor.

The concrete example will be described. The fixed contactor used in the embodiment is one as shown in a perspective view in FIG. 70. As is recognized from the view, an arc runner 14 is provided with a forked portion 14*d* which are outside of the fixed contact 8A and gradually converges to the free end. And it is also provided with a piece having the same width as the fixed contactor. Namely, the arc runner 14 is connected to the fixed contactor 8 by narrow pathes.

Thus, by using the fixed contactor having the above-mentioned shape, an urging force to the arc produced can be increased.

FIG. 71 shows another embodiment of the arc runner 14. By providing the arc runner 14 as illustrated, the urging of the arc 12 can be further accelerated, and both current limiting ability and current breaking ability can be increased.

An embodiment as shown in FIGS. 72–76 has a fixed contactor 8 improved in the same manner as the embodiment shown in FIGS. 70 and 71.

Namely, the embodiment of FIGS. 72–76 has been attained as a result of study on the shape of the fixed contactor 8. By forming a ridge-like projection at the central portion of the fixed contactor 8 at the outer side of the fixed contact 8A and along its longitudinal direction an arc is rapidly urged. This embodiment minimizes the influence of heat against the side wall surrounding the fixed contactor and the inching life can be prolonged.

The embodiment of the present invention will be described with reference to the drawing.

Figure 72:
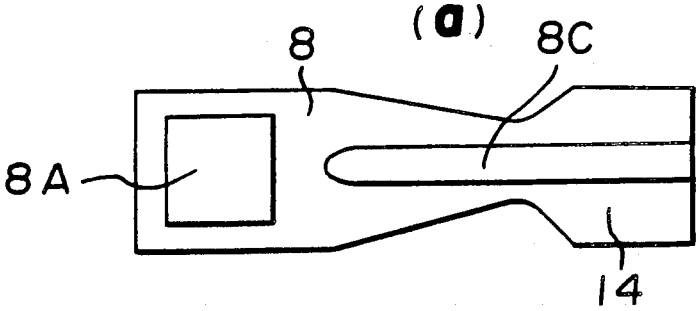
FIGS. 72*a*, 72*b* and 72*c* are perspective views showing a fixed contactor according to another embodiment of the present invention.
Figure 72:
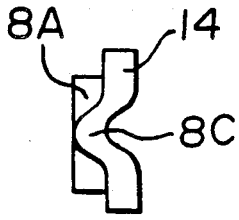
Figure 72:
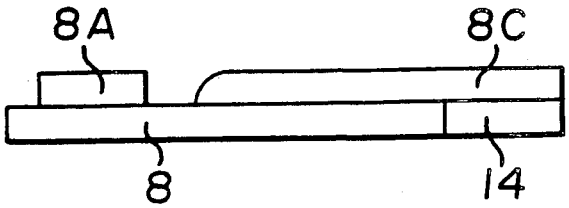

The embodiment of FIG. 72 is characterized by forming a ridge-like portion 8C at the central portion of an arc runner 14 in its longitudinal direction and at the outer side so as to extend toward the free end with respect to the fixed contact 8A, and the width of the central portion of the arc runner is narrowed, while the width at the free end side is made broad.

Figure 73:
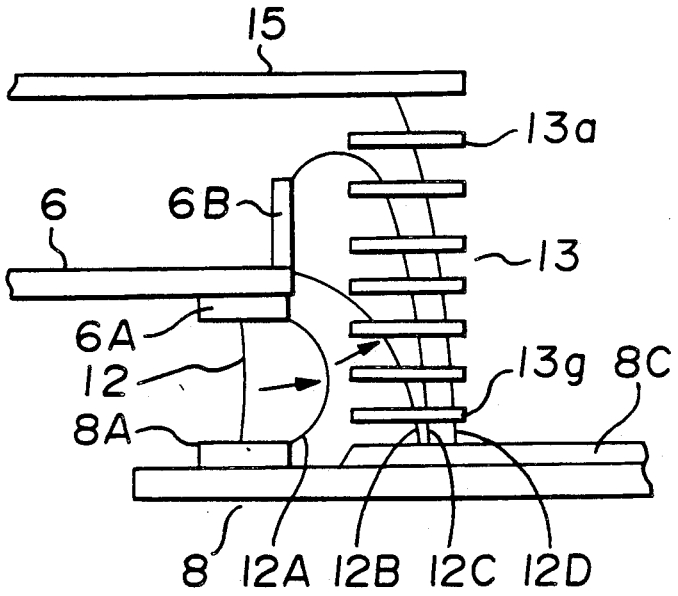
FIG. 73 is a cross-sectional view of an important part of an embodiment of the present invention in which the fixed contactor shown in FIG. 72 is used.

FIG. 73 shows an embodiment of the present invention in which the fixed contact 8 made as shown in FIG. 72 is used.

In FIG. 73, when the movable contact 6A is separated from the fixed contact 8A, an arc 12 is produced.

The arc 12 takes a progress that it becomes an arc 12A in a short time by the influence of magnetic substance; it is attracted to the arc extinguishing metallic plates 13 and moves on the arc runner 14 to take the form of an arc 12B and then an arc 12C successively; it finally becomes an arc 12D, and it is cooled by the arc extinguishing metallic plates 13 to be extinguished.

In the movement of the arc, since the projection is formed on the arc runner in the fixed contactor 8, arc attracting effect is increased so as to urge the arc.

When the urging of the arc after the generation of the arc and the shift of the arc from the state of the arc 12C to the state of the arc 12D are satisfactorily obtained. Time required for interruption is shortened, and the current limiting ability is increased as described before.

Accordingly, arc energy at an interruption time is decreased to allow interruption of a large electric current.

In the above-mentioned embodiment, an arc horn 6B is joined to the end portion of the movable contactor 6A. However, the arc horn 6B may be omitted.

In the case of the device described with reference to FIG. 73, the length of the arc extinguishing metallic plates 13 is made the same. However, the length can be determined in such a manner that at least one of the arc extinguishing metallic plates 13 is extended to a position corresponding to, for instance, the fixed contactor 8A as described in the previously mentioned embodiment (with reference to, for instance, FIG. 49), and the end portion of the elongated arc extinguishing metallic plate is forked to have two legs.

Figure 74:
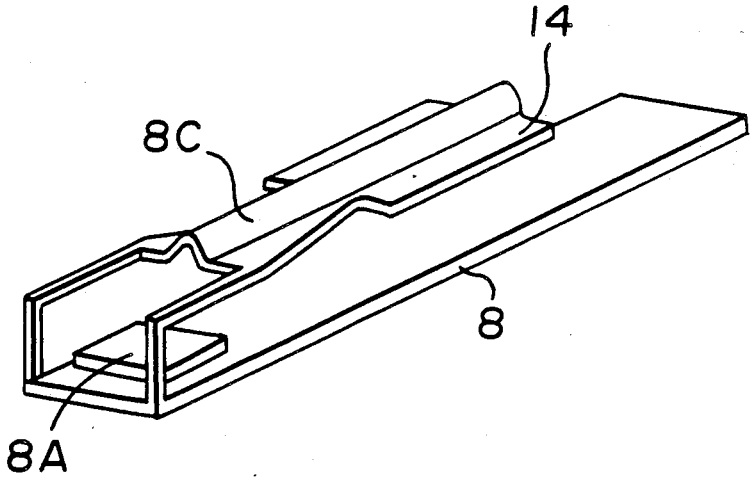
FIGS. 74 and 76 are respectively perspective views of other embodiments of the fixed contactor according to the present invention.

Further, a fixed contactor 8 provided with an arc runner 14 as illustrated in FIG. 74 may be used instead of the fixed contactor 8 as in FIG. 72.

In this case, the end portion at the side of the fixed contact 8A of the fixed contact 8 is bent in an inversed L-shape.

An arc extinguishing structure in which the above-mentioned fixed contactor is used will be described with reference to FIG. 75. In the same manner as the embodiments described before, when an arc 12 is produced between the movable contact 6A and the fixed contact 8A, the lower leg of the arc 12 on the fixed contact 8A is easily transferred onto the arc runner 14 whereby the state of the arc 12A is changed to the state of the arc 12B because the projection 8C is formed on the arc runner 14.

Figure 75:
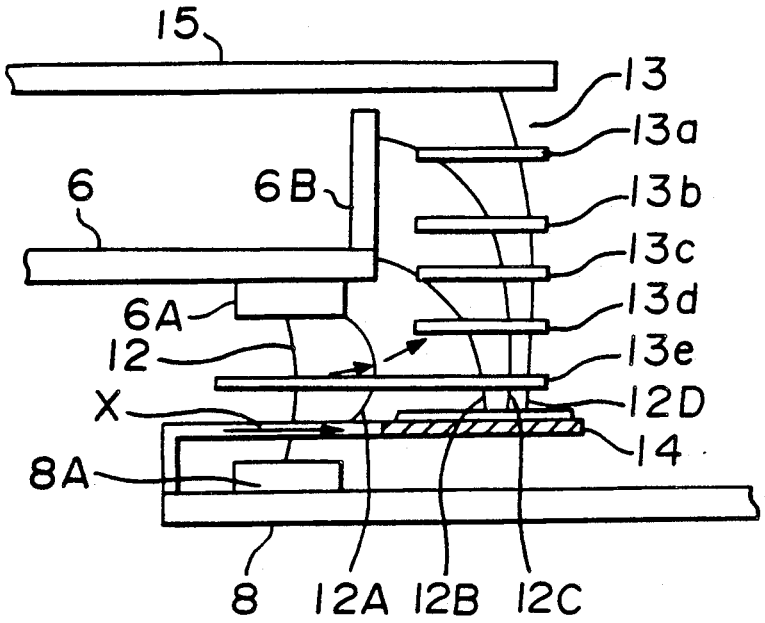
FIG. 75 is a cross-sectional view of an important part of another embodiment in which the fixed contactor shown in FIG. 74 is used.
Figure 76:
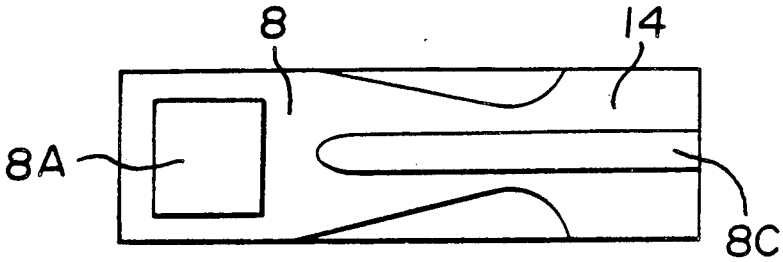
Figure 76:
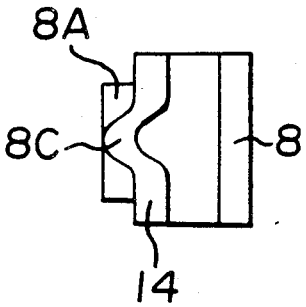
Figure 76:
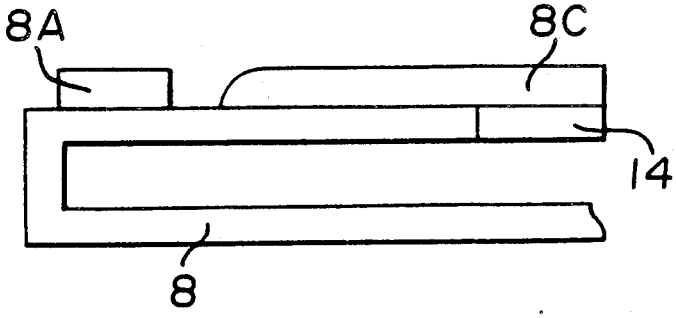

When the lower leg of the arc 12 is transferred onto the arc runner 14, an electric current flows in the arc runner 14 in the direction of an arrow mark X as shown in FIG. 75, and the arc 12A is further urged toward the terminal portion of the arc runner 14.

The upper leg of the arc 12A is transferred from the movable contact 6A to the end portion of the movable contactor 6 and the arc is attracted to the arc extinguishing metallic plates 13. The lower leg runs on the arc runner 14 from the fixed contact 8A.

The upper leg of the arc 12B transferred on the movable contactor 6 is successively urged by arc extinguishing metallic plates 13, and the arc 12C elongated by the arc extinguishing metallic plates 13 is transferred to the arc runner 14 by moving on all of the arc extinguishing plates **13*a*–13*e* of the arc extinguishing metallic plates 13**, and is finally extinguished.

Thus, by providing the projection on the arc runner 14, the urging of the arc 12 is further accelerated, whereby both current limiting ability and current breaking ability can be further increased.

As modified examples on the fixed contactor 8 as shown in FIG. 72, ones as shown in FIGS. **76*a*, 76*b* and 76*c*** may be used.

It goes without saying that the same effect as in the previously mentioned embodiments can be obtained even in these cases.

In the previously mentioned embodiments, the arc extinguishing metallic plates 13 with the legs **13*ga* placed between the fixed contact 8A and the movable contact 6A** may be a single or a plural number.

INDUSTRIAL APPLICABILITY

The present invention is widely applicable to a switch such as an electromagnetic contactor, a breaker for wiring, an air circuit breaker and so on used for factries, homes and so on.

We claim:

1. In a switch comprising a fixed contact joined to a fixed contactor, a movable contact joined to a movable contactor to face said fixed contact, a plurality of arc extinguishing metallic plates arranged with predetermined distances therebetween and in parallel to said fixed contactor at an end portion of said movable contactor, and a commutation plate placed at the side of said arc extinguishing metallic plates opposite said fixed contactor so that said movable contactor is positioned between said commutation plate and said fixed contactor, wherein at least one plate of said arc extinguishing metallic plates is located adjacent said fixed contactor and has one end which extends in a direction toward said movable contactor and is spaced from said fixed contactor, and said one end has a space formed therein so that said movable contact is movable therethrough for being brought into contact with said fixed contact.

2. The switch according to claim 1, wherein said one end includes first and second leg portions which extend beyond a perpendicular line of the mutual contact between said fixed contact and movable contact.

3. The switch according to claim 1, wherein the arc extinguishing metallic plate closest to said fixed contact and the extinguishing metallic plate closest to said commutation plate are extended beyond a perpendicular line of the mutual contact between said fixed contact and movable contact.

4. The switch according to claim 1, wherein a plurality of said arc extinguishing metallic plates closest to said commutation plate extend to a side of said space through which said movable contact is movable.

5. The switch according to claim 1, wherein an arc extinguishing metallic plate closest to said commutation plate extends to a side of said space through which said movable contactor is movable.

6. The switch according to claim 1, wherein an end portion of each of said extinguishing metallic plates extends to a side of said space through which said movable contactor is movable.

7. The switch according to claim 1, wherein said plurality of arc extinguishing metallic plates are spaced apart by predetermined distances and are parallel with said fixed contactor, said arc extinguishing metallic plates include relatively long plates having leg portions on opposite sides at one end arc extinguishing metallic plates arranged alternately so that said one end portion of said longer arc extinguishing metallic plates are positioned vertically adjacent said movable contactor.

8. The switch according to claim 1, wherein a projection is formed at an end portion of each of said arc extinguishing metallic plates.

9. The switch according to claim 8, wherein said projection is formed on a front surface facing one of said commutation plate and said fixed contactor.

10. The switch according to claim 1, wherein insulating material is interposed between adjacent ones of said arc extinguishing metallic plates.

11. The switch according to claim 1, wherein an insulating material is provided at a side of said arc extinguishing metallic plates so as to control the discharging of arc gas produced between said fixed contact and said movable contact.

12. The switch according to claim 1, wherein said commutation plate is U-shaped so that the end of a leg portion thereof faces a back face portion of said movable contact.

13. The switch according to claim 12, wherein said leg portion of the commutation plate has a side inclined to a free end side thereof.

14. The switch according to claim 1, wherein said commutation plate includes a bent portion having a substantially U-shape and which is positioned between said movable contactor and said arc extinguishing metallic plate, and a top portion of said bent portion is substantially flush with a position where open-circuiting of said movable contactor is completed.

15. The switch according to claim 1, wherein a width portion of said commutation plate is broaden at both ends thereof, and a projection is formed at a central portion thereof so as to contact an arc.

16. The switch according to claim 1, wherein a projection is formed on said commutation plate at a central portion thereof at the free end side so as to contact an arc.

17. The switch according to claim 1, wherein a projection is formed on said arc extinguishing metallic plates at a central portion thereof in a width direction.

18. The switch according to claim 1, wherein at least one surface of said arc extinguishing metallic plates is covered by an insulating material.

19. The switch according to claim 1, which comprises insulating material located between said arc extinguishing metallic plates for controlling discharging of arc gas.

20. The switch according to claim 1, wherein the width of said arc extinguishing metallic plates at a side of said movable contact is relatively narrow, and a width portion of the end portion at an opposite side is relatively broad.

21. The switch according to claim 1, wherein said commutation plate and said arc extinguishing metallic plates are radially broaden at a location apart from said movable contact.

22. THe switch according to claim 1, wherein an arc runner is continuous with respect to said fixed contactor.

23. The switch according to claim 22, wherein a fixed contact is formed on one surface of said fixed contactor, and an arc runner is connected to said fixed contactor through a narrow path portion.

24. The switch according to claim 22, which comprises a projecting part formed at a central portion in the longitudinal direction of said arc runner.

25. The switch according to claim 1, which comprises an arc horn formed at an end portion of said movable contactor which faces an end portion of said arc extinguishing metallic plates.

* * * * *